US005636763A

United States Patent [19]

Furness

[11] Patent Number: 5,636,763

[45] Date of Patent: Jun. 10, 1997

[54] GAS PRESSURIZED LIQUID DELIVERY SYSTEM

[76] Inventor: Geoffrey M. Furness, 14 Fordyce Avenue, Pakuranga, Auckland, New Zealand

[21] Appl. No.: 299,373

[22] Filed: Sep. 1, 1994

[30] Foreign Application Priority Data

Nov. 4, 1993 [NZ] New Zealand ..... 250136

[51] Int. Cl.[6] ..... B67D 5/08

[52] U.S. Cl. ..... 222/54; 222/61; 222/66; 222/148; 222/399

[58] Field of Search ..... 222/54, 61, 62, 222/64, 66, 148, 152, 399, 394

[56] References Cited

U.S. PATENT DOCUMENTS

| | | | |
|---|---|---|---|
| 3,878,970 | 4/1975 | Nezworski | 222/61 |
| 3,898,861 | 8/1975 | McMillin | 222/61 |
| 4,143,793 | 3/1979 | McMillin et al. | 222/64 |
| 4,304,136 | 12/1981 | McMillin et al. | 222/62 X |
| 4,564,128 | 1/1986 | Belich | 222/135 |
| 4,687,120 | 8/1987 | McMillin | 222/61 |
| 4,848,381 | 7/1989 | Livingston et al. | 222/148 |
| 4,869,396 | 9/1989 | Horino et al. | 222/61 |
| 5,007,560 | 4/1991 | Sassak | 222/61 |
| 5,090,440 | 2/1992 | Ladouceur et al. | 222/148 |
| 5,268,849 | 12/1993 | Howlett et al. | 141/94 |

FOREIGN PATENT DOCUMENTS

| | | |
|---|---|---|
| 0487214 | 5/1992 | European Pat. Off. . |
| 1384607 | 2/1975 | United Kingdom . |

*Primary Examiner*—Andres Kashnikow
*Assistant Examiner*—Lisa Ann Douglas
*Attorney, Agent, or Firm*—Jacobson, Price, Holman & Stern, PLLC

[57] ABSTRACT

A gas pressurized liquid delivery system. In particular but not solely for the dispensing of beverages such as beer, cider or stout. A logic circuit whether hard wired or computer or PLC controlled and whether centralized or distributed provides for the operation of the system. The run-out of an individual container in a series of containers is detected by way of a flow indicating device within a fluid pathway. The logic circuit then switches in another container in the series. The switching can be in order of connection to the circuit or an inputed manufactured date. Various cycles are provided by the logic circuit, for example, a cleaning cycle, sterilizing cycle and a purge cycle. These cycles are able to be enacted substantially automatically. A container eg. keg connector is also provided. In at least a preferred form of the invention the container connector contains a microprocessor forming or containing part of the above mentioned logic circuit.

26 Claims, 15 Drawing Sheets

$CO_2$
31
32
59
59
66
55
65
50
52
53
70
69
68
67
64
OPTIONAL (STERILIZER)
(DETERGENT)
54
$H_2O$
51
10
6
5
7
8
9
33
14A
20
16
15
18
19
34
14
4
40
60
61
62
1
2
41
63
43
42
46
3
44
45

GAS PRESSURIZED LIQUID DELIVERY SYSTEM

BACKGROUND OF THE INVENTION (1) Field of the Invention

This invention relates to apparatus for the dispensing of liquid from containers, the sterilization and/or cleansing of at least part of the dispensing apparatus and/or methods therefor.

(2) Description of the Prior Art

In the past, a number of inventions have been directed towards providing a liquid dispensing system, of these a number are directed towards providing for the switching of the container being dispensed from, eg. soon after a container has become empty, it is switched out of the circuit and a different full container, if one is available, is switched into the circuit. In particular, U.S. Pat. No. 4,564,128 relates to a beverage dispensing system having a single source of pressure for a plurality of containers of a particular beverage and a dispensing line for each container communicating with a separate tap. The taps for a particular beverage are mounted together and each is provided with a lock, thereby allowing the operator to select which tap will operate at a given time and accordingly disable the other tap(s). The run out of a particular container must be protected by the operator, there is no provision of the automatic detection of the run out of a container and/or the automatic switching to dispensing from another full container.

Also disclosed in European Patent Specification No. 487214 is beverage dispensing system cleaning apparatus. However, the beverage dispensing system cleaning apparatus involves the disconnection of the connectors to the various containers and the provision of a flushing sleeve which is located upon the outlet of the beer taps. The beer taps must also be manually opened in order to provide an outlet for the cleaning fluid. It does not provide for the automated cleaning the beverage dispensing system.

In order to provide for the switching between a beverage container which is empty or nearly so and a container which is full it is useful to have a means to detect the build up of gas or absence of a liquid in a liquid supply line. To this end UK Patent Specification No. 1384607 provides means including a chamber a float within the said chamber said float supporting a first permanent magnet below a second permanent magnet which is located above and outside the chamber. The magnets being so oriented so that they mutually repel whereby movement in response to a movement in the magnet supported by the float results in a fluid signal from the fluidic device. This signal is used to provide an indication of the build up of gas or absence of liquid in the liquid supply. There is no provision of providing for the detection of liquid run out in a substantially unaltered conduit. There is further no disclosure of the use of electrical, in particular, solid state means to detect the run out of a liquid.

With a 'centralised' or downstream means of detecting the build up of gas, rather than detecting and control means at each container, it is not possible to avoid gas filled lines, which will cause frothing and dispensing problems when a new container is connected to that line, or will at least require additional means to bleed or otherwise remove the gas from the lines.

In practice such a system also requires providing means to prevent drawoff of liquid during changeover from a container which is empty to a container which is full ie. continuous drawoff of liquid during changeover is not possible.

BRIEF SUMMARY OF THE INVENTION

It is an object of the present invention to provide a gas pressurized liquid delivery system which provides for the switching between containers as the containers become empty and/or provides a substantially automated cleaning of said liquid delivery system, and/or provides selective fluid communication between multiple containers and multiple outlet taps and/or provides means of recording usage or consumption of containers and their contents and recording of cleaning operations.

As used in this specification gas pressurized liquid delivery system is defined to include:

(1) in a preferred form an above atmospheric gas pressurized system; or (2) less preferably a pumped system (either motor driven or manually operated) which utilises an outlet (not necessarily at the bar or dispensing station) of substantially less than atmospheric pressure.

In and/or for a gas pressurized liquid delivery system, the use of (I) an assembly connectable to a container from which liquid is to be expressed under gas pressure, said assembly being connectable into, to and/or about an opening of a said container and defining, a fluid pathway having a fluid inlet connectable to receive a liquid being gas pressure moved up a conduit from adjacent the bottom of the container (if said assembly is not located adjacent the bottom of the container) from said container and a fluid outlet connectable in use to a fluid conduit, at least one remotely operable valve between said fluid inlet and the fluid outlet, an inlet for a pressurizing gas and an outlet for the pressurizing gas or liquid at or adjacent said fluid inlet whereby a pressurizing gas can be provided in use at least into the container about said fluid conduit, and flow indicating means within said fluid pathway (preferably between said remotely operable valve and said fluid inlet, and (II) a logic circuit (hard wired and/or computer or PLC or computer AND/OR serial or parallel microprocessor(s) controlled where microprocessors are part of a centralised or distributed control network, and if microprocessor(s) are part of a distributed control network, microprocessor circuits are integral with said assembly and include means to sense and/or indicate said flow indicating means and control said remotely operable valve and optionally to sense and/or control and/or indicate liquid flow rate and/or liquid or room temperature and/or gas pressure in keg or said fluid pathway) whereby in a first situation where said remotely operable valve has been opened and fluid is passing through said fluid pathway from the container associated with the assembly, said remotely operable valve is closed or allowed to close responsive to a signal from said flow indicating means (with or without additional logic input from or reference to a computer, microprocessor, PLC or other sensing means either remote or integral with assembly which may override such signal) of a fluid flow indicative of the container being empty or almost empty, and in a second condition, where said remotely operable valve is closed but is in communication with a container to which the assembly is connected, and is opened or allowed to open (at least where there is a demand for the fluid of the system and subject to any additional logic requirement as aforementioned) and a like assembly has just halted fluid flow from another container under action from the logic circuit (as in the first condition aforesaid).

Preferably said assembly includes a second valve preferably interposed between said remotely operable valve and said fluid inlet and said gas inlet such that any pressurizing gas and container liquid can be shut off beyond said valve but both may be capable of being dispensed under the control of said remotely operable valve once said second valve is opened.

Preferably said flow indicating means within said fluid path way is as close as possible to said fluid inlet.

Preferably said remotely operable valve is biased (eg. by spring or other means) to a closed condition when not being energized.

Preferably said remotely operable valve is a pilot operated two stage in-line electrically operated solenoid valve.

Preferably said flow indicating means are of an optical liquid sensor.

Preferably said flow indicating means comprises a solid state liquid level switch which utilises the principle of total internal reflection.

Preferably said flow indicating means comprises a solid state liquid level switch RS 317-819 available from RS Components, 12 Saunders Place, Auckland, New Zealand.

Preferably said logic circuit comprises a programmed computer or PLC or a combined computer and/or separate serial or parallel microprocessor(s) where microprocessors are part of a distributed control network.

Preferably said distributed control network consists (in part) of separate microprocessor circuits attached to each said assembly.

Preferably said programmed computer also includes a form of usage monitoring, recording and control and, optionally a system of automatic re-ordering, liquid flow, temperature and gas pressure monitoring and/or recording.

Preferably said computer program allows the said containers to be dispensed from in the order they are connected into the system alternatively said computer program allows said containers to be dispensed from in the order of manufacturing, ie. brewing. The date of manufacturing being preferably read in from a bar code on said container.

Preferably said system also includes means to inject into said fluid pathways and/or assembly cleaning and/or optional sterilization means.

Preferably said cleaning means comprises a concentrated liquid or solid alkaline detergent substantially dissolved or mixed with water.

Preferably said optional sterilization means comprises concentrated liquid iodophors or hydrogen peroxide/peracetic acid solution or ozone substantially dissolved or mixed with water.

Preferably said concentrated cleaning and optional sterilizing means are injected and mixed into a flowing water stream by means of an injector/mixer without requirement for external pumping of the cleaning and/or sterilizing substances. Less preferably positive-displacement chemical feed pumps would be employed.

Preferably said system includes means to purge said fluid pathway and/or assembly of fluid by means of a dispensing gas (or water) independent of the pressurizing gas into the container.

Preferably said system includes means to pre-rinse said fluid pathway and/or assembly with water prior to injecting cleaning means if purge is carried out with gas rather than water.

Preferably said independent dispensing gas is injected by means of pathways used to inject said sterilization and/or cleaning means. Alternatively, said independent dispensing gas is injected by means of pathways independent of pathways used to inject said sterilization and/or cleaning means.

Preferably said system includes means to flush from said fluid pathways and/or said assemblies the cleaning and/or sterilization means.

Preferably said assembly includes one way valve(s) to restrict the flow of container liquid but substantially not restrict the flow of said independent dispensing gas and/or said cleaning and/or sterilization fluid.

Preferably said assembly includes additional one way valve(s) to restrict the flow of said independent dispensing gas and/or said cleaning and/or sterilization fluid into the container.

Preferably said system includes means to re-prime said fluid pathways with fluid.

Preferably said means to purge, flush, prime and clean fluid pathways are controlled (with the ability to purge, flush, prime and clean individual or combinations of multiple lines as programmed), sequenced and recorded by the said computer programme or PLC or computer and/or serial or parallel microprocessor(s), in a centralised or distributed control network.

Preferably cleaning and flushing fluids are distributed by means of mains water pressure or where mains water pressure is insufficient by means of a pump.

Preferably cleaning and flushing fluids are utilised in a one-pass, non-recycling sequence. Alternatively, cleaning and flushing fluids are recirculated by means of a pump after mixing is completed.

Preferably the control system provides means to automatically terminate the purge and re-prime cycles.

In a further aspect the present invention consists in a liquid dispensing system having an outlet tap operable at a liquid dispensing station (eg. a bar) to dispense liquid, at least two kegs or other containers (hereafter "kegs"—the term keg being as hereafter defined), conduiting means from said kegs to said outlet tap, an remotely operable valve in said conduiting means at or adjacent each said keg, gas pressurizing or pumping means (as defined) to pressurize the contents of each keg to allow the expressing of liquid therefrom into said conduiting means if allowed by said remotely operable valve and from there, if allowed, out of said outlet tap, a liquid flow detector in said conduiting means at or adjacent each said keg, and logic means (hard wired and/or computer or PLC or computer AND/OR serial or parallel microprocessor(s) controlled) where microprocessors are part of a centralised or distributed control network and if microprocessor(s) are part of a distributed control network, microprocessor circuits are integral with said assembly and include means to sense said flow indicating means and control said remotely operable valve and optionally to sense and/or control liquid flow rate and/or liquid or room temperature and/or gas pressure in keg or said fluid pathway) whereby in operation at least one of said remotely operable valves opens a passageway for liquid to move under gas pressure from a liquid containing keg under the control of said outlet tap, and whereby said remotely operable valve is closed or allowed to closed by said logic means responsive to an indication of a liquid flow from said keg indicative of the keg being empty and/or soon to be empty (and in satisfaction of any other logic requirements), said logic means or substantially simultaneously therewith opening or allowing the opening of an remotely operable valve of another keg such that there is a minimum of gas inflow into said conduiting means between each said remotely operable valve and said outlet tap.

By the term "keg" is meant individual kegs or movable or in-situ tanks or a grouping thereof connecting in series, or parallel to decant one into another or individually or simultaneously and from there into said conduiting means.

Preferably said conduiting means is connected into the top of each said keg or to the bottom of a tank (such tank having no internal fluid pathway to move liquid from adjacent the bottom of the tank to the opening of the tank).

Preferably each said keg is provided with an internal conduit from adjacent the bottom thereof (if said connection is not located adjacent the bottom of the keg) to the connection with said conduiting means, said connection allowing gas inflow into the keg about such internal keg conduiting and the upflow of liquid from such a keg responsive to said gas pressure when such flow is permitted by a said outlet tap and/or the associated remotely operable valve.

Preferably an additional valve is provided at or adjacent each such keg such that said conduiting means can be closed independent of said remotely operable valve, eg. as might assist during the adding of fresh kegs or the removal of empty kegs from the battery of kegs.

Preferably said conduiting means is preferably a common conduiting means for each keg to be connected in sequence, etc as permitted by the logic means to a particular outlet tap or taps.

Preferably said conduiting means includes a valved connection to a washing fluid circuit and said connection to said washing connection circuit is permitted by said logic means only when each said remotely operable valve is closed, and In another aspect the present invention comprises apparatus capable of producing a system as described above.

In another aspect the present invention comprises an assembly connectable to a container from which liquid is to be expressed under gas pressure (or pumped as defined), said assembly being connectable into, to or about an opening of said container and defining a fluid pathway having a fluid inlet connectable to receive a liquid being gas pressure moved up a conduit from adjacent the bottom of the container (if said assembly is not located adjacent the bottom of the container) from said container and a fluid outlet connectable in use to a fluid conduit;

at least one remotely operable valve between said fluid inlet and fluid outlet;

an inlet for a pressurizing gas and an outlet for the pressurizing gas or liquid at or adjacent said fluid inlet whereby a pressurizing gas can be provided in use at least into the container about said fluid conduit, and flow indicating means within said fluid pathway.

Preferably said flow indicating means is located between said remotely operable valve and said fluid outlet or inlet and preferably as close as possible to said fluid inlet.

Preferably said flow indicating means comprises a optical liquid sensor.

Preferably said optical liquid level sensor utilises the principle of total internal reflection.

Preferably said liquid level sensor comprises a solid state liquid level switch RS 317-819 available from RS Components Limited, 12 Saunders Place, Auckland, New Zealand.

Preferably an inlet for a sterilizing or cleansing liquid and/or gas and an outlet for said sterilizing or cleansing liquid and/or gas whereby a cleansing or sterilizing liquid and/or gas may be routed through at least part of said fluid pathway.

Preferably a one way valve is provided between said inlet for sterilizing or cleansing liquid and/or gas and said outlet for gas or liquid.

Preferably a one way valve is provided between said inlet for pressurizing gas and said outlet for pressurizing gas or liquid.

Preferably said assembly is connectable into a logic circuit whereby in a first situation where said remotely operable valve has been opened and liquid is passing through said fluid pathway from a container associated with the assembly, said remotely operable valve is closed or allowed to close responsive to a signal from said flow indicating means (with or without additional logic input) of liquid flow indicative of the container being empty or almost empty.

In yet another aspect the present invention consists in a method of cleansing and/or sterilizing a liquid dispensing system, said liquid dispensing system dispensing from at least one container, said container being connected into said liquid dispensing system by means of a connector, said connector having:

a fluid pathway having a fluid inlet connectable to receive a liquid being gas pressure moved (or pumped as defined) up a conduit from adjacent the bottom of said container (if said connector is not located adjacent the bottom of the container) and a fluid outlet connectable in use to a fluid conduit;

at least one remotely operable valve between said fluid inlet and fluid outlet;

an inlet for pressurizing gas or liquid and an outlet for pressurizing gas or liquid at or adjacent said fluid inlet whereby a pressurizing gas can be provided in use at least into the container about said fluid conduit; and a cleansing and/or sterilizing fluid pathway having a fluid inlet connectable to receive said cleansing and/or sterilizing fluid and a fluid outlet in communication with said fluid pathway, said communication occurring immediately downstream of said fluid pathways fluid inlet and said remotely operable valve;

said method comprising the steps of substantially closing or keeping closed said remotely operable valve;

causing a cleansing and/or sterilizing fluid to pass through said cleansing and/or sterilizing fluid inlet, said cleansing and/or sterilizing fluid exiting through said fluid outlet.

Preferably said cleansing fluid comprises concentrated liquid or solid alkaline detergent substantially dissolved or mixed with water.

Preferably said sterilizing fluid comprises concentrated liquid iodophors or hydrogen peroxide/peracetic acid solution or ozone substantially dissolved or mixed with water.

Preferably a remotely operable valve is provided in said gas pressurized liquid dispensing system such that said cleansing and/or sterilized fluid and/or gas may exit said gas pressurized liquid dispensing system.

Preferably said remotely operable valve has associated therewith a flow indicating means.

Preferably said flow indicating means and said remotely operable valve is connectable into a logic circuit whereby there is the prospect of operation in at least one or more of the following situations:

a first situation the liquid remaining in said liquid dispensing system can be substantially purged or drained from said system;

a second situation in which said cleansing and/or sterilizing fluid is caused to flow within said liquid dispensing system;

a third situation in which said cleansing and/or sterilizing fluid and/or water is purged or dispensed from said system through said remotely operable valve;

a fourth situation in which gas is purged from said system through said remotely operable valve (as in re-prime mode);

in the first and third situation said remotely operable valve is closed or allowed to close responsive to a signal from said flow indicating means of liquid flow indicative of said system being empty or almost empty of said fluid liquid to be purged or dispensed; and in the fourth situation said remotely operable valve is closed or allowed to close responsive to signal from said flow indicating means liquid flow indicative of said system being full or almost full of said fluid liquid to be dispensed.

Preferably said gas pressurized liquid dispensing system is substantially as hereinbefore described.

In yet another aspect the present invention consists in a gas pressurized liquid dispensing system (or pumped system as defined);

said gas pressurized liquid dispensing system dispensing from at least two containers (whether comprising a single container, containers connected in series or multiple containers connected in parallel hereinafter "containers") and dispensing out multiple taps;

said multiple containers and said multiple dispensers being connected by means of an array of remotely operable valves such that at least two containers can be selectively dispensed from at least one tap or at least two taps can selectively dispense from at least one container.

Preferably said remotely operable valves are of the normally closed type.

Preferably said liquid dispensing system is substantially as hereinbefore described.

Preferably said remotely operable valves are controllable by a logic circuit.

Preferably said array of interconnections comprises an array of remotely operable valve-interrupted fluid pathway connections between fluid pathways individually connected to said containers and fluid pathways individually connected to said dispensing means.

Preferably the connection of any said container to said dispensing means or any said dispensing means to any said container that is undesirable is prevented by means of the blockage or non-connection of said fluid pathway associated with said dispensing means and said fluid pathway associated with said container.

The invention consists in the foregoing and also envisages constructions of which the following gives examples.

BRIEF DESCRIPTION OF THE DRAWINGS

The preferred form of the present invention will now be described with reference to the accompanying drawings in which.

DETAILED DESCRIPTION OF THE PREFERRED EMBODIMENT

Figure 1:
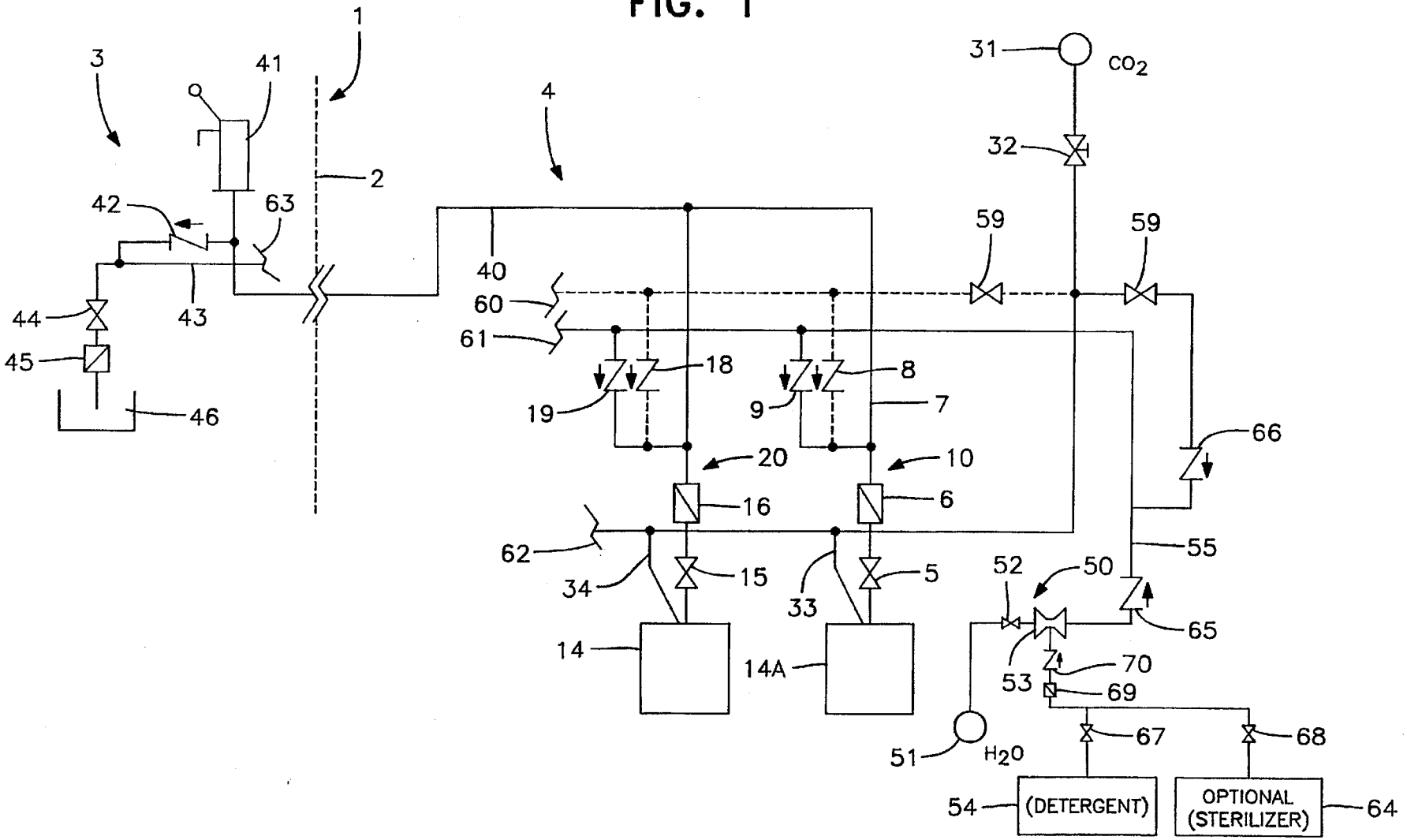
FIG. 1 is a diagrammatic view of one form of the present invention.
Figure 2:
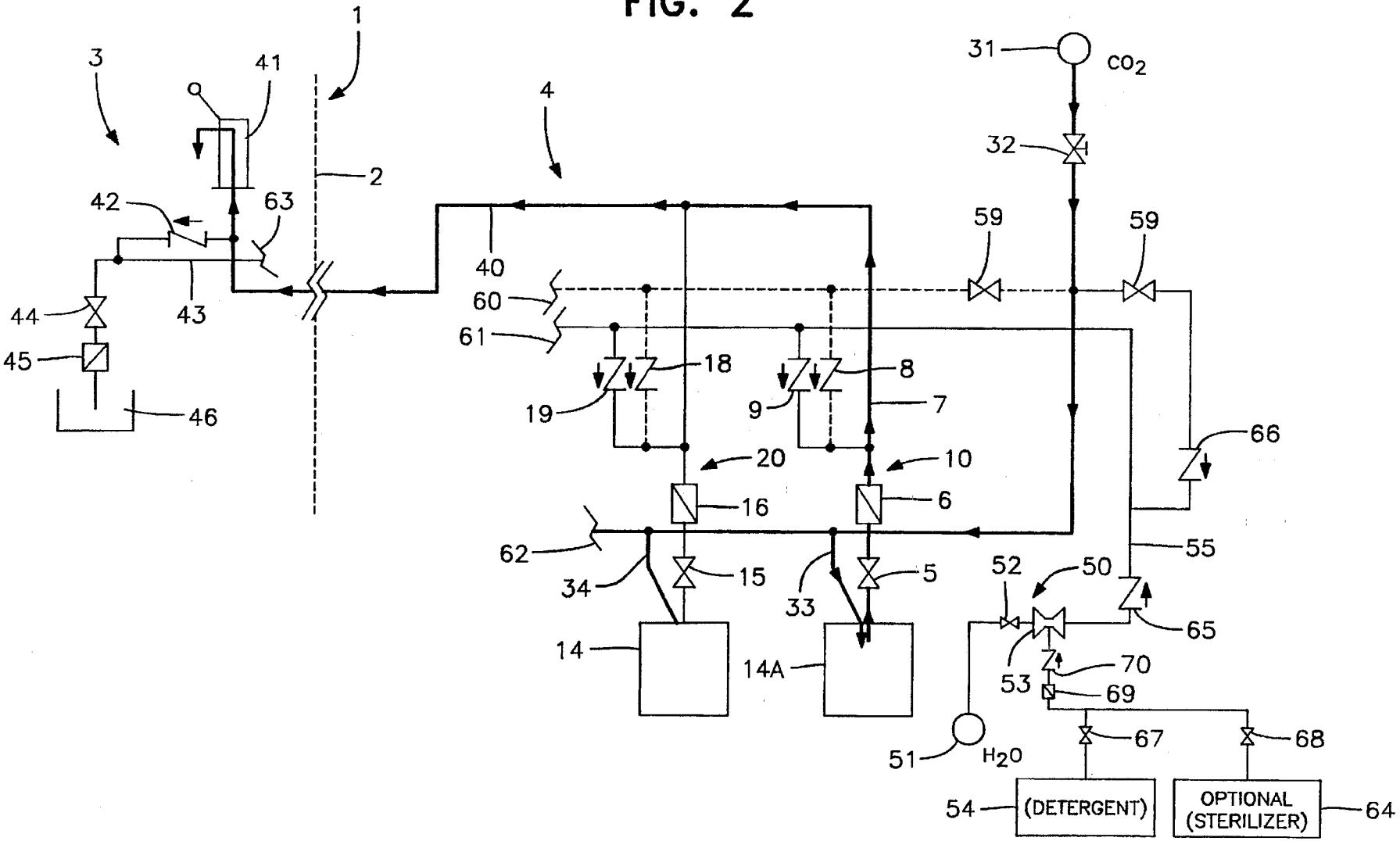
FIG. 2 is a diagrammatic view of a form of the invention as illustrated in FIG. 1 when decanting from a container.
Figure 3:
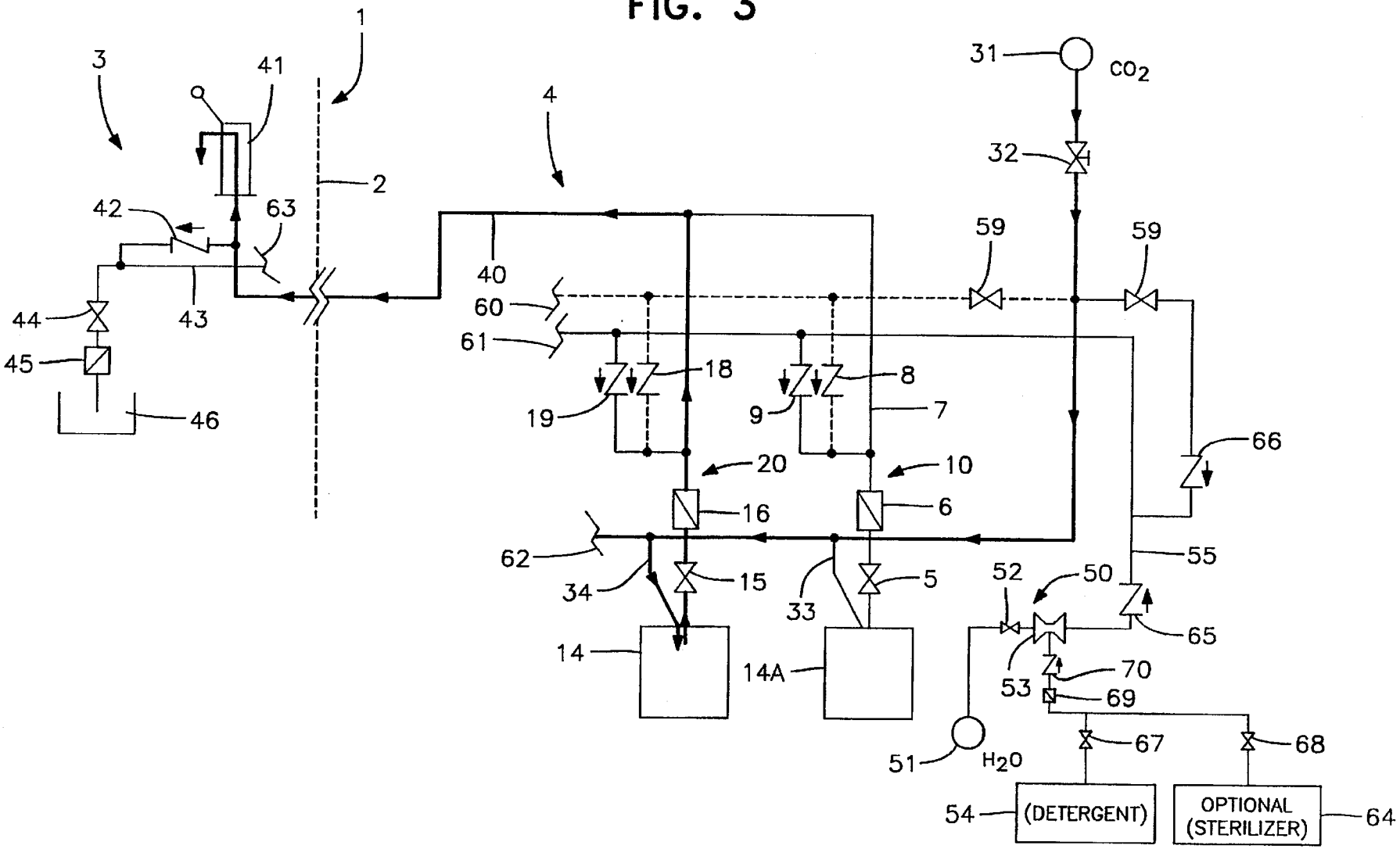
FIG. 3 is a diagrammatic view of one form of the invention when decanting from another container.

As shown in FIGS. 1 to 8 one form of the present invention comprises a system of connecting at least two containers from which liquid can be expressed under gas pressure to at least one fluid outlet or outlet tap. The invention preferably also provides for the purging, cleaning, flushing and re-priming of said system.

This system may be used, for example, in a bar where the at least two containers 14 and 14A are kegs and the fluid outlet or outlet tap 41 is a beer tap.

The form of the invention as illustrated is constructed from a series of interconnected pipes, hoses, fluid pathways or tubes which are at least in preferred forms of the invention when used to transport beer, cider or other similar beverages manufactured from a food grade plastics material. When used in one of its preferred forms to provide a supply of, for example, beer or cider to a bar, the system may be divided into two parts a section 3 which is accessible in the dispensing area of the bar and a section 4 which is substantially non-accessible from the dispensing area of the bar the two sections may be divided by a wall 2. The section 4 (or part thereof, except gas supply) may be, for example, contained within a cool store or a non-cooled storeroom in which case an under bar cooling system may be provided to cool the beer, cider or similar beverage before it is dispensed.

The temperatures of individual dispensing lines may be monitored by the control system with indicating means used to announce status.

Figure 13:
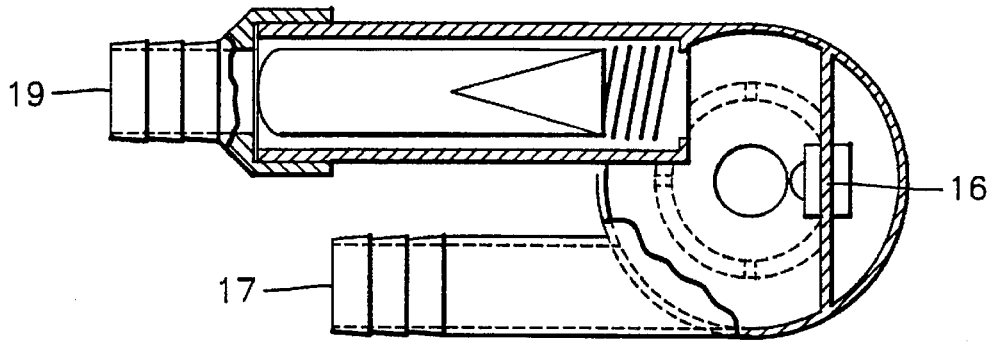
FIG. 13 shows a partial sectional view of a container connector according to one form of the present invention.
Figure 14:
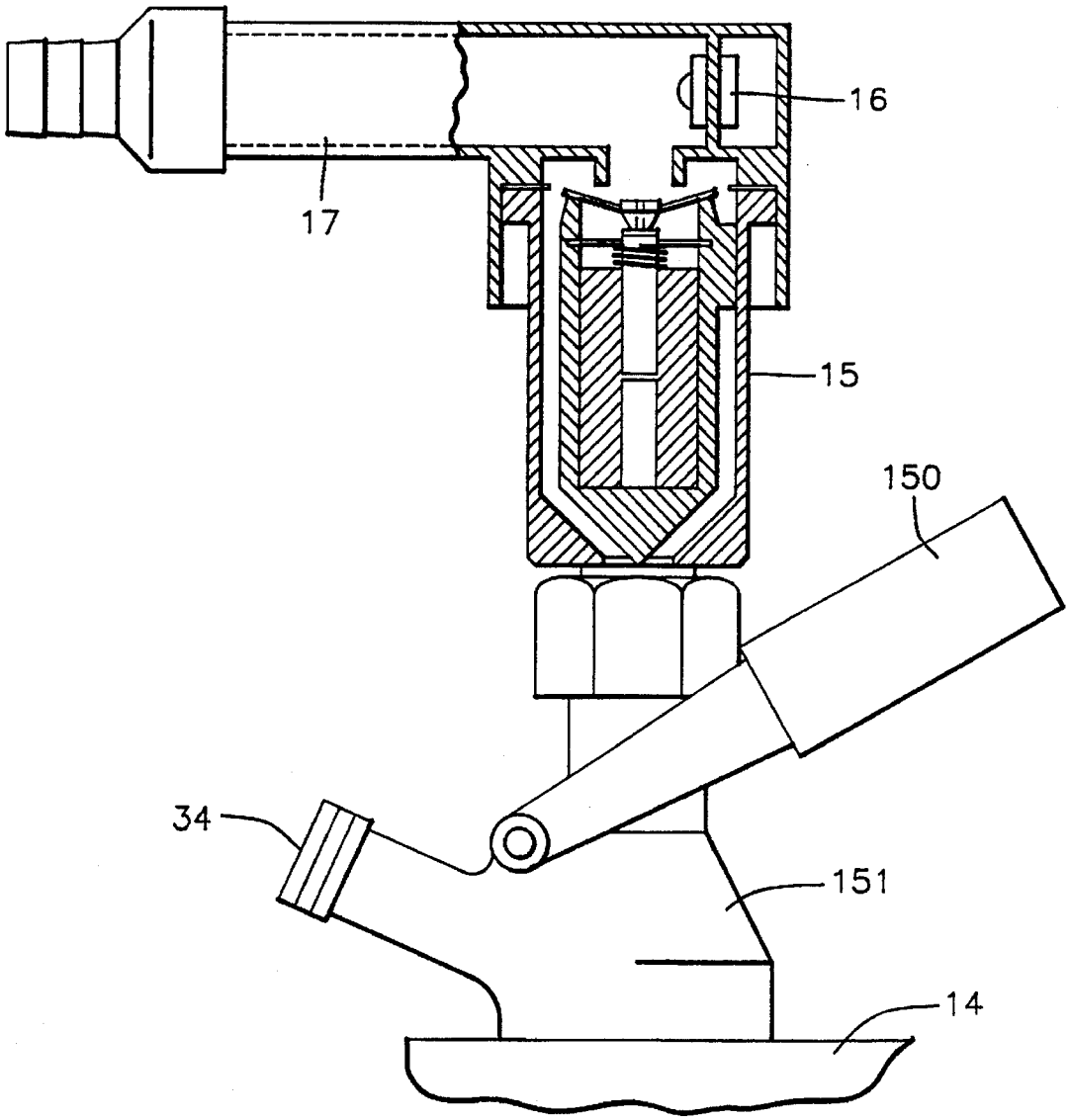
FIG. 14 is a partial sectional view of a container connector according to one form of the present invention.
Figure 15:
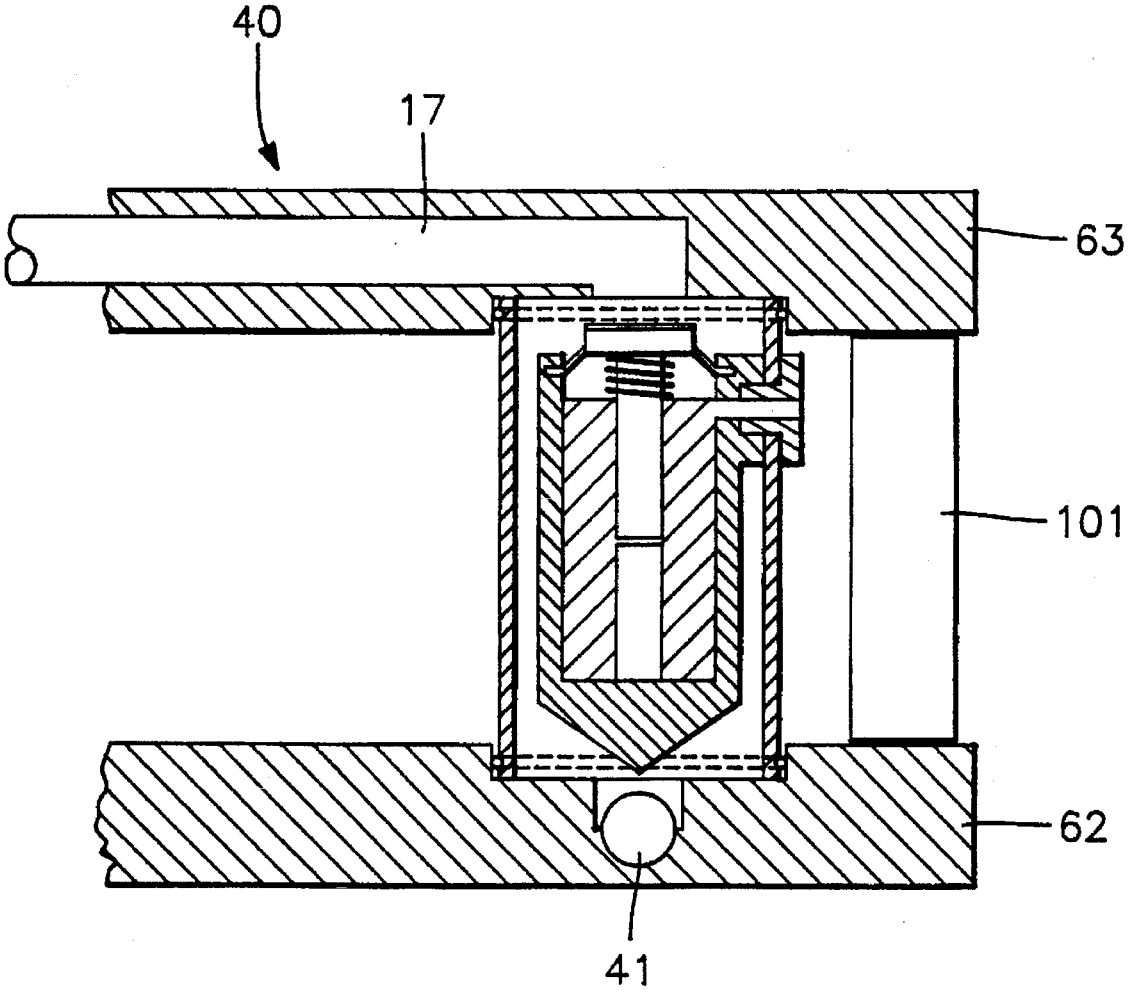
FIG. 15 is a partial sectional view of an alternative remotely operable valve with the form of the invention as shown in FIG. 11.
Figure 16:
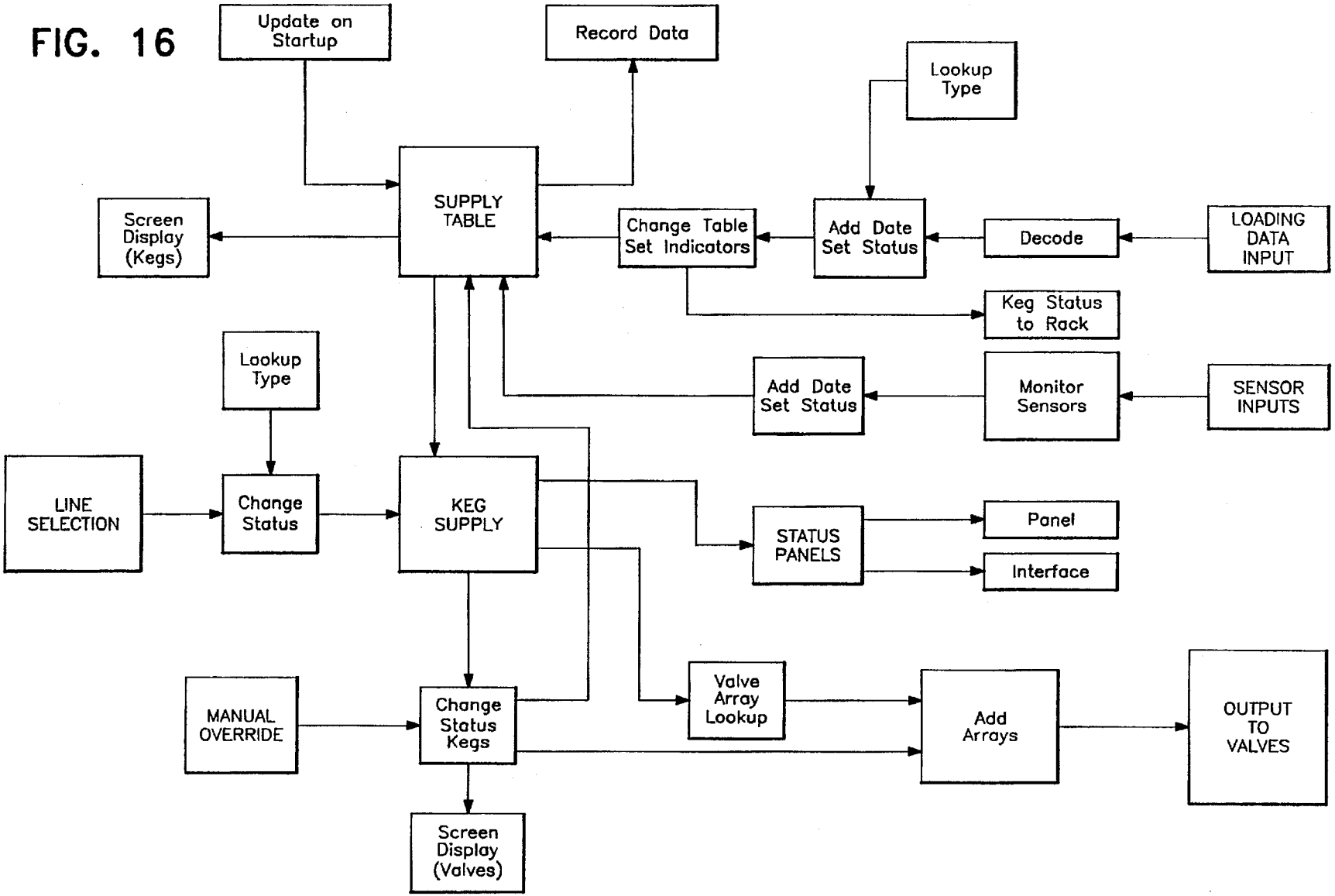
FIG. 16 is a schematic diagram of the logic circuit (excluding cleaning logic) according to one form of the present invention.
Figure 17:
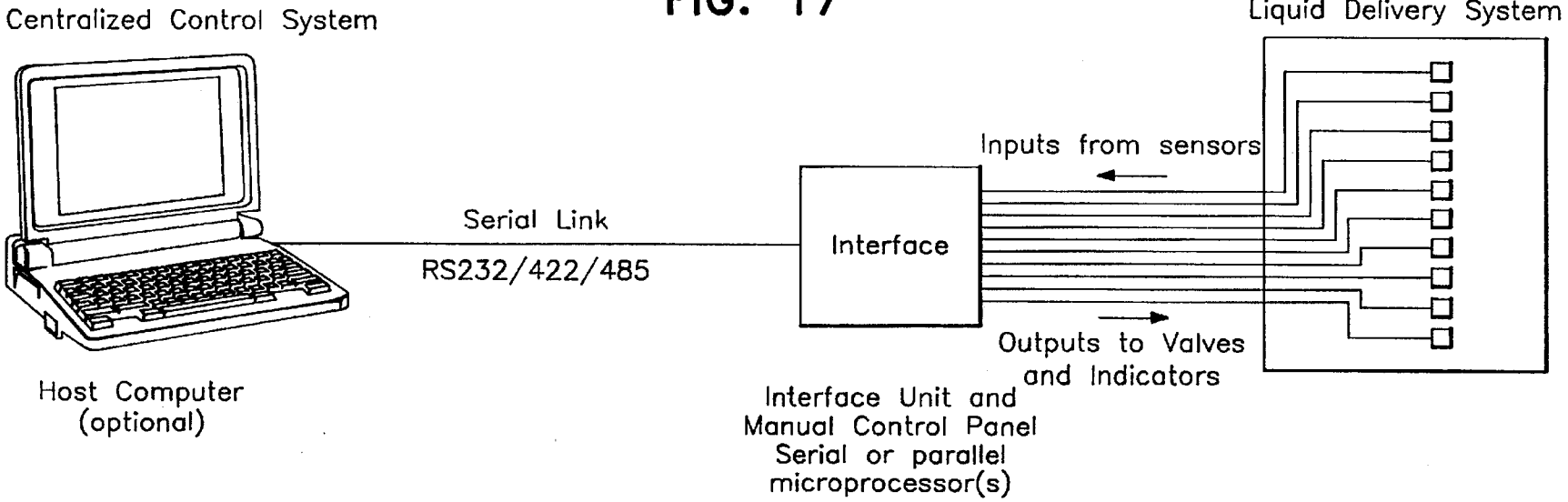
FIG. 17 is a schematic diagram showing connections between logic elements according to one form of the present invention.

As shown in FIG. 1 present in the dispensing system are a series of normally closed solenoid valves 5, 15, 44, 52, 59, 67 and 68. These valves are operated under the control of the logic circuit, for example as shown in FIG. 16. Thus the logic circuit can convert the state of the said solenoid valve from closed to open thus allowing flow to occur. In forms of the invention the valves are transformed into the open state for only as long as a signal is present from the logic circuit. In other less preferred forms of the invention the valves remain open until such time as a signal to close the valves occurs. The solenoid valves 5, 15, 44, 52, 59, 67 and 68 are, when used in a system to dispense beer, cider or similar beverage are manufactured from a food grade or approved type of material. In forms of the invention these valves may consist of a in-line, direct acting or two stage pilot operated solenoid valve. The valve plunger or diaphragm is biased towards a closed position by means of, for example, a compression spring. The two stage pilot operated valve provides additional protection against the possibility of cleaning fluid contamination of keg supply by requiring substantially higher cleaning fluid pressures to open such valve in reverse flow, than would be the case with a direct acting valve. A form of this valve is shown in FIGS. 13 and 14. Those skilled in the art to which the invention relates will realise that a variety of differing valves electrically operable may be utilised.

Also present in a preferred form of the system are flow indicating means or liquid/gas sensors 6, 16, 45 and 69. These are sensors are of a type that provides little or no impediment to the flow of liquids and gases past by or through them. The function of these liquid/gas sensors 6, 16, 45 and 69 is to provide a signal indicative of the presence of flow of a liquid past the said sensor. In a preferred form of the invention the said sensors provide a signal upon the fluid flowing past or through said sensor changing from substantially that of a liquid to substantially that of a gas or from substantially that of a gas to substantially that of a liquid.

In a preferred form of the invention this is achieved by means of a solid state optical liquid sensor which utilises the principle of total internal reflection by means of an integral LED and photo sensor so arranged so that when a liquid does not cover the sensor a light path is established between them. Thus the sensor is able to provide a signal indicative of the presence of a liquid and a differing signal upon the presence of a gas.

Those skilled in the art to which the invention relates will realise that a variety of other suitable sensors may be utilised. Suitable sensors are able to provide a fast indication of the change in fluid flowing past or through said sensor from that substantially of a liquid to that substantially of a gas or from that substantially of a gas to that substantially of a liquid. In preferred forms of the invention the sensors are of a food grade or certifiable type, that is, they have substantially no adverse effect upon the liquid and/or gas flowing past said sensor.

Figure 18:
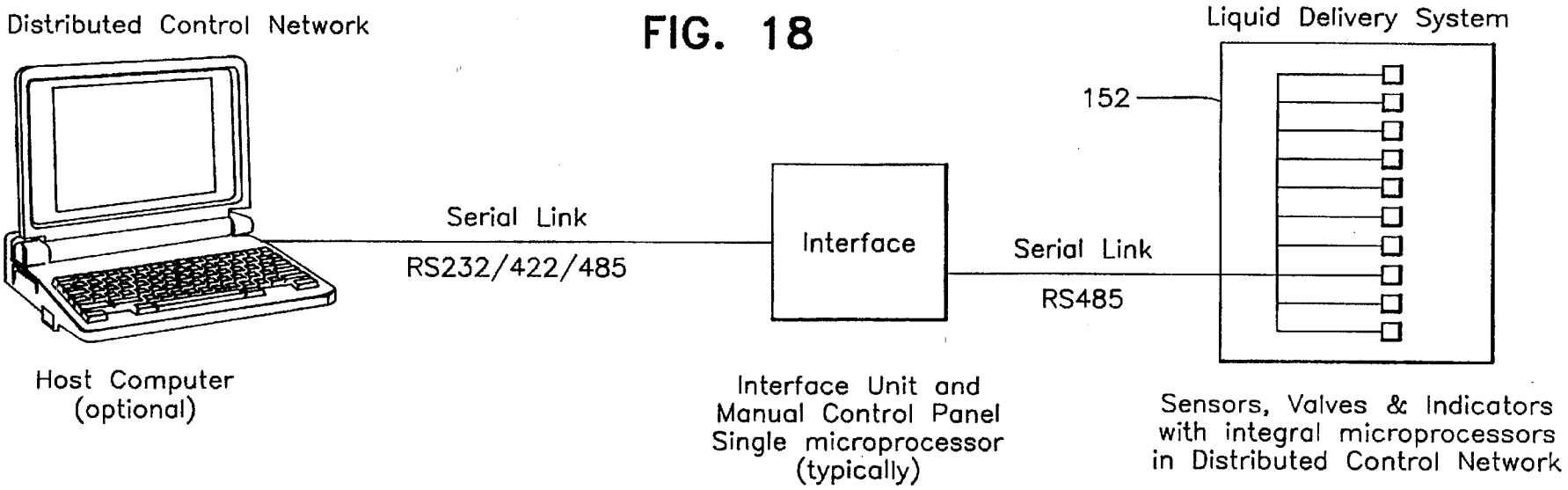
FIG. 18 is a schematic diagram showing connections between logic elements according to one form of the present invention.

Also present in a preferred form of the system is a microprocessor circuit 152 which gives the solenoid valve/sensor assembly "intelligence", allowing it to be part of a distributed control network. For example see FIG. 18.

Also present at least a preferred form of the system are several one way valves 8, 9, 18, 19, 42, 65, 66, 70. These valves substantially allow the flow of fluid in one direction and substantially prevent the flow of fluid in the opposing direction. Those skilled in the art to which the invention relates will realise that a variety of valves may be utilised. In preferred forms of the invention the valves are suitable for use in a food or consumable liquid system eg. a food grade or certifiable type. One preferred form of the invention utilises the valves for liquid flow comprising a nylon (or similar) shuttle which is spring biased to substantially occlude a hole through which liquid may (when hole is not occluded) pass. The occlusion of said hole substantially prevents the flow of liquid unless the said shuttle is moved away from a position occluding the hole against the biasing means. The direction in which flow is substantially allowed by the said one way valves is denoted by arrows in the diagrammatic views 1 to 8. Valves for gas flow (8, 18) are preferably of the 'duckbill' type and are only required if the alternative arrangement of individual purge lines to each keg is utilised.

In a preferred form of the invention which utilises a standard connector for 50 l kegs there may be present a handle 150 which is used to initiate the connection of said connector to a standard keg fitting by causing valves present in the keg 14 (as they are in various known kegs) to be opened.

Also present in standard fittings is an additional one way valve (not shown) at location 151. This provides an added security in addition to the solenoid valve against the egress of cleaning and/or sterilization substance into the container 14.

In order to provide for the decanting of liquids from the containers 14 and 14A a source of gas 31 is provided. This source may be a container of compressed gas, a generator whether utilising chemical re agents or otherwise or a compressor. As is known in one form of the invention this source 31 comprises a source of compressed carbon dioxide. The use of carbon dioxide to decant liquid such as beer, cider, etc, is well known in the art to which the invention relates. Other suitable gases include nitrogen which can be used to provide for the decanting and a suitable amount of "head" for such beverages as stout. The source of gas 31 is in preferred forms of the invention provided with a manually operable shut off valve 32. In other forms of the invention this shut off valve may be a remotely operable solenoid valve and may optionally be located downstream of the junction of valve 59 and $CO_2$ source.

The supply pressure(s) for these gas(s) may be monitored by the control system with indicating means used to announce status.

In order to provide for the cleaning and/or sterilization of the said beverage dispensing system a source of cleansing substance 54 and/or optional sterilizing substance 64 is provided. Those skilled in the art to which the invention relates will be aware that a variety of suitable cleaning and/or sterilizing substances could be used. In preferred forms of the invention the flow of cleaning and/or sterilizing substance is controllable by the said control system and valves 67, 68. In a preferred form of the invention the cleaning and/or sterilizing substance is injected into a supply or flow of water by means of an injector/mixer 53. The water is supplied from a water source 51 and the supply of water is preferably controllable by said control system by means of a solenoid valve 52 and a pressure regulator (not shown). Those skilled in the art to which the invention relates will realise that a variety of suitable injectors 53 may be utilised.

In a preferred form of the invention flushing and cleaning fluids are used in a one-pass, non recycling sequence. Alternatively such flushing and cleaning fluids may be recirculated by means of a pump after mixing is complete under control of the control system or logic circuit.

As an alternative to the use of chemicals, the cleaning and/or sterilizing means may be provided by an ozone source.

The use of an ozone generator and an injector 53 in order to inject ozone into a supply of water 51 can provide an alternative food grade cleansing and/or sterilizing system but is less preferred.

Figure 4:
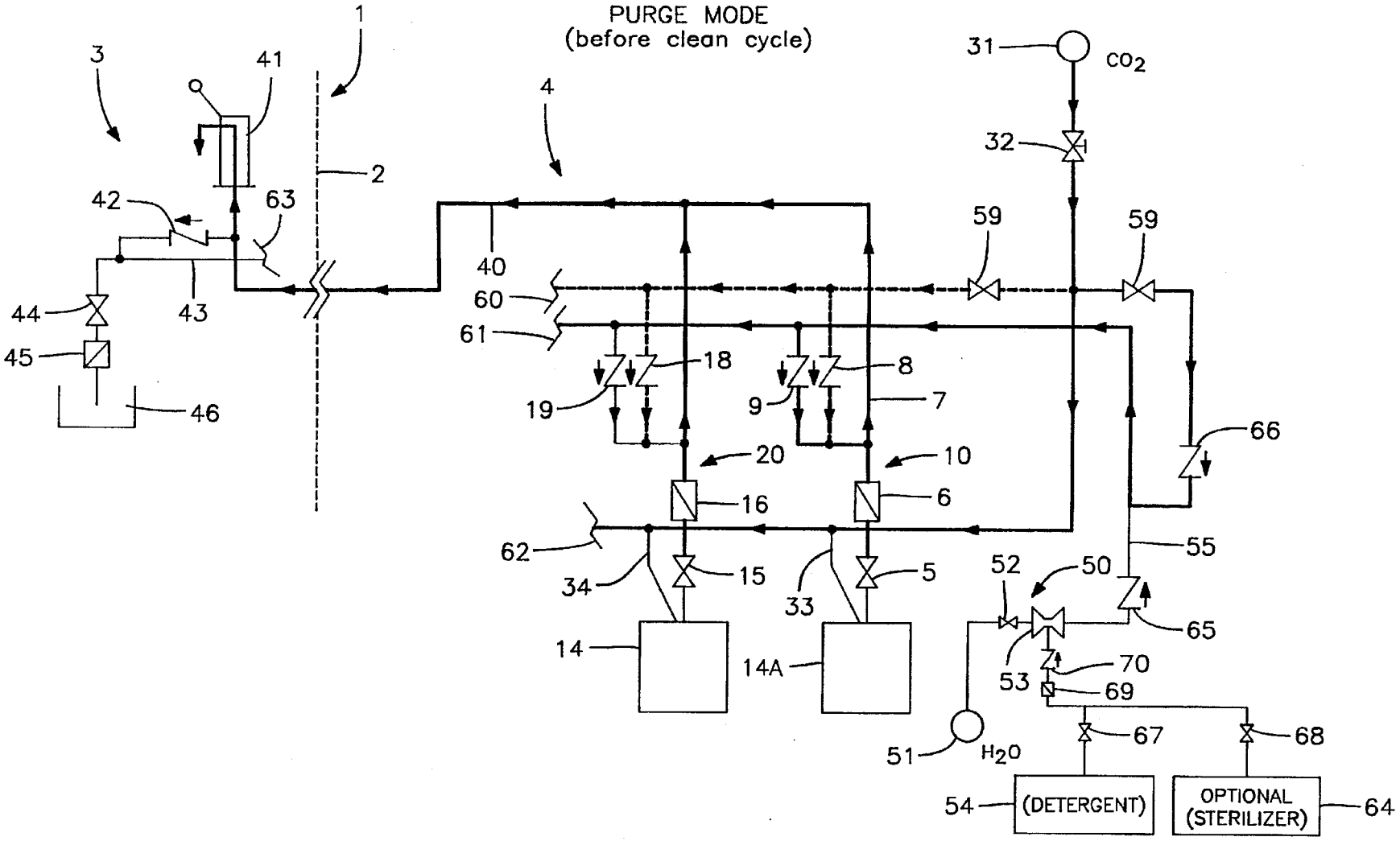
FIG. 4 is a diagrammatic view of a form of the invention when in purge mode.
Figure 5:
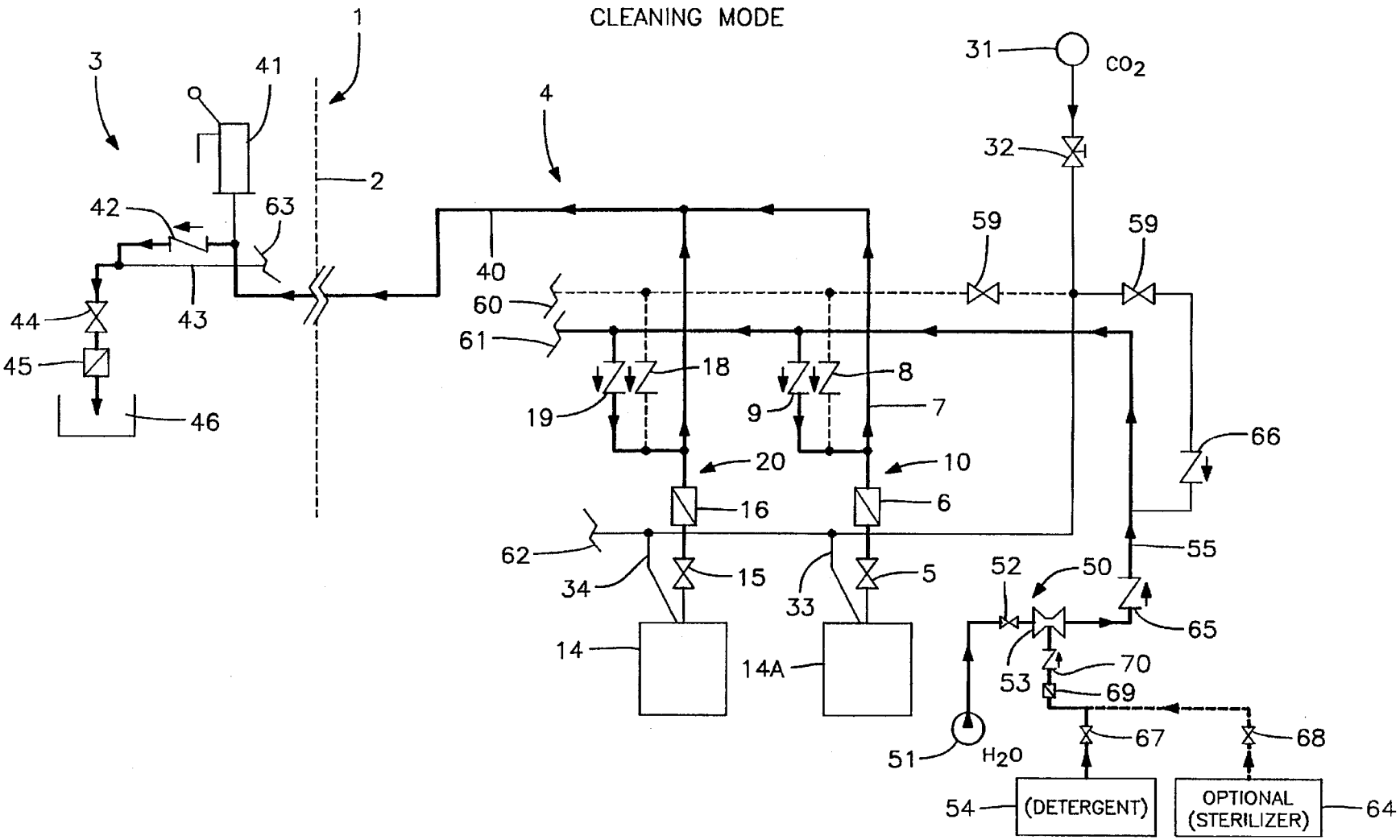
FIG. 5 is a diagrammatic view of one form of the present invention when in cleaning or sterilizing mode.

It can be seen from the Figures that in at least a preferred form of the invention two purge modes are provided, a first purge mode which occurs before the cleaning mode and is shown in FIG. 4 and a second purge mode which occurs after the cleaning mode and substantially removes the cleaning substance and/or water from the system. The first purge mode, as shown in FIG. 4, substantially purges the dispensable liquid, eg. beer, cider, stout etc, from the pipes before cleaning occurs. As no cleansing and/or sterilizing substance is present in the system at this stage and the substance used to purge the system is preferably 31, for example, carbon dioxide or other substance which substantially does not affect the drinkability of said dispensable liquid, the liquid purged from the system can be dispensed from the tap or dispenser 41 and, if desired, consumed in the normal manner. In other forms of the invention the liquid may be simply directed through the operable valve 44 and into the drain 46.

Figure 7:
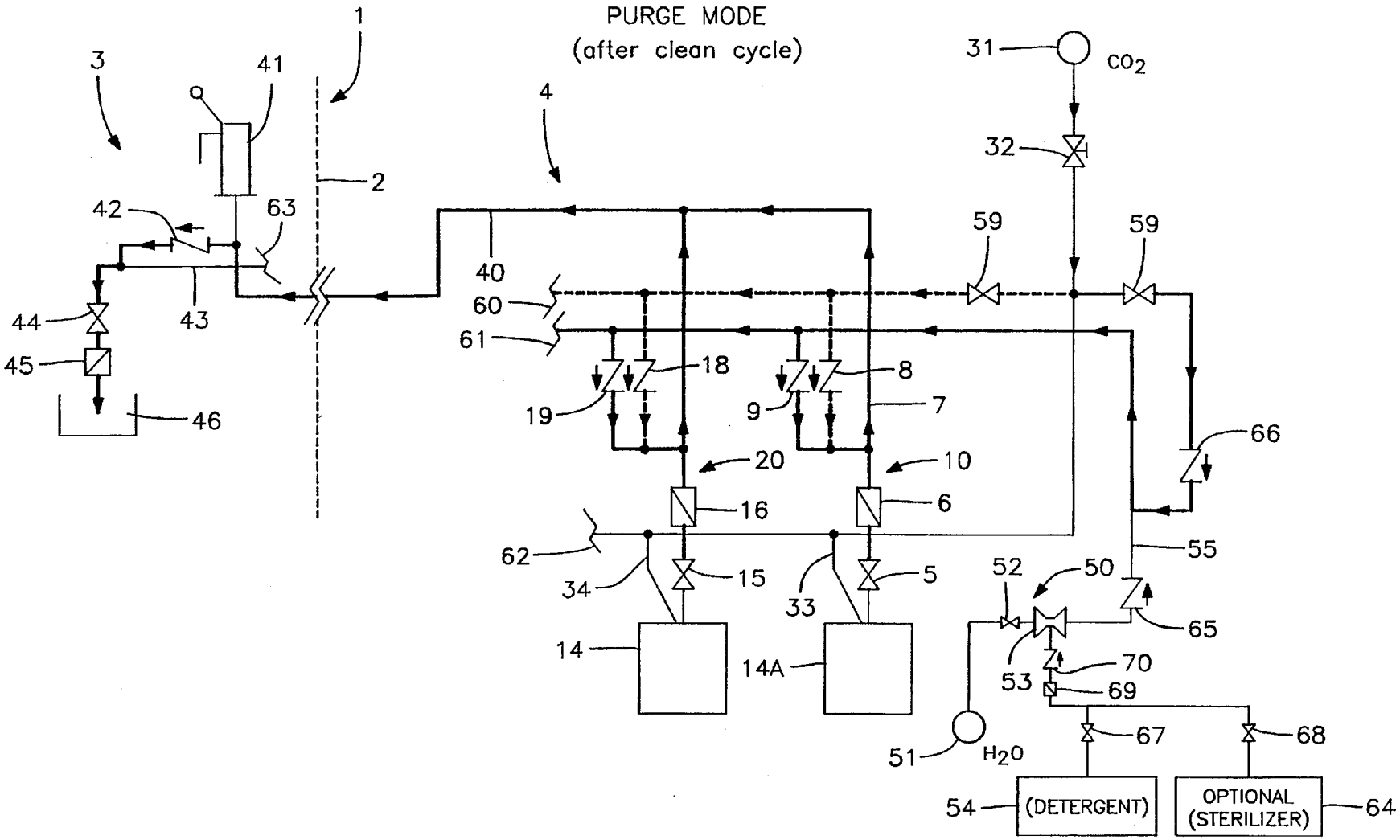
FIG. 7 is a diagrammatic view of one form of the present invention when in purge mode (after cleaning cycle)

The (optional) second purge mode, as shown in FIG. 7, purges the system of flushing water and/or cleansing substance again by using the source 31, for example, carbon dioxide. In this mode the cleansing substance is preferably drained through the remotely operable valve 44 into the drain. However, for at least part of the cycling of the mode the dispenser 41 may be opened and thus purge the dispenser itself of the cleansing and/or sterilizing substance and/or flushing water. When in the second purge mode, sensor 45 is used to detect the change from liquid to gas. Thus when sensor 45 detects that a change has occurred from substantially liquid to substantially gas the logic circuit may terminate the purge mode thus ensuring that substantially little gas is wasted. It will be seen by those skilled in the art to which the invention relates that by the addition of valves or similar, for example, using the array of remotely operable valves hereinbefore described the lines leading to the container 14 and 14A and any other that may be present may be either separately or in groups purged, cleaned, flushed, purged again, if desired, and re-primed.

Figure 8:
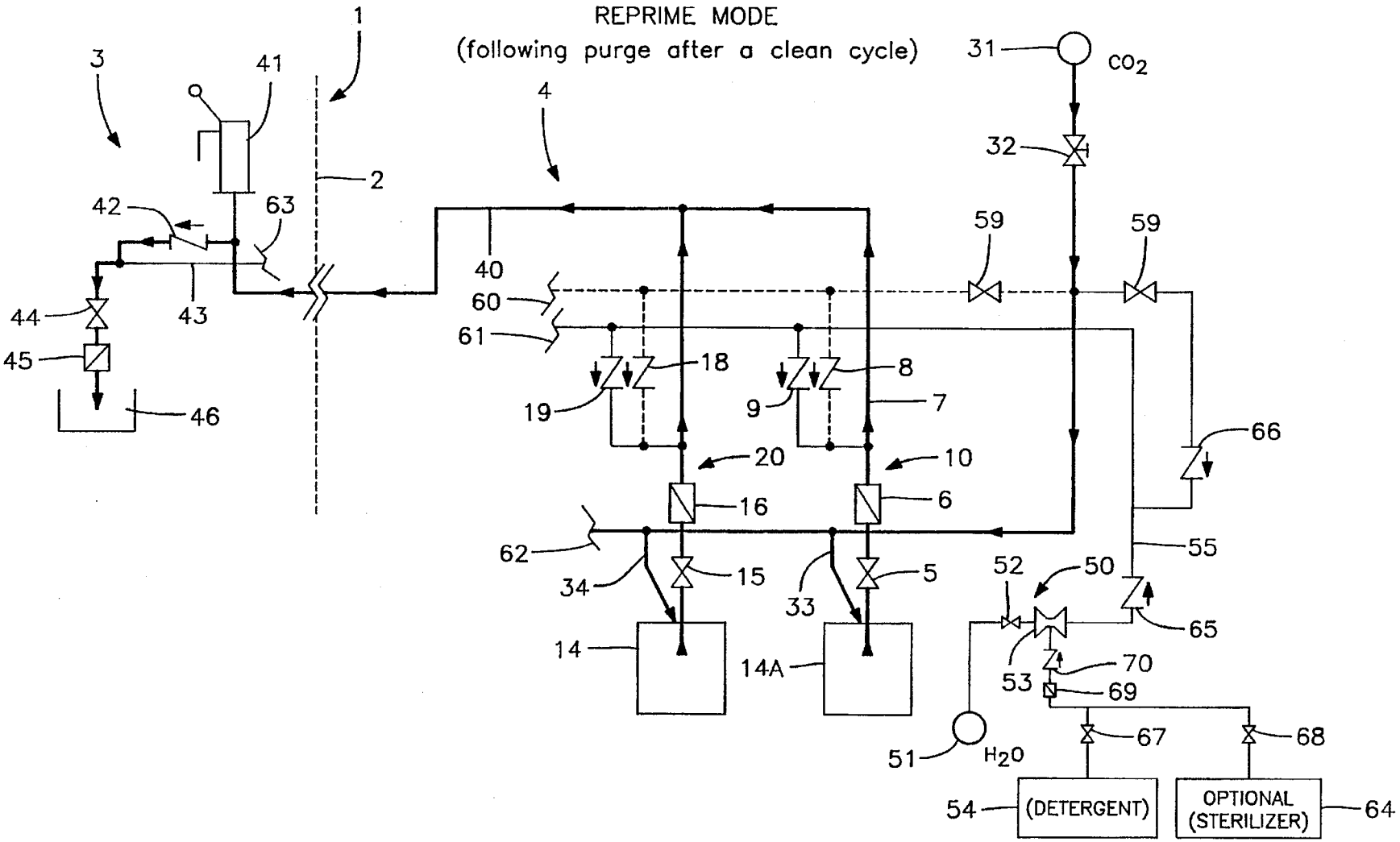
FIG. 8 is a diagrammatic view of a one form of the present invention when in re-prime mode.
Figure 9:
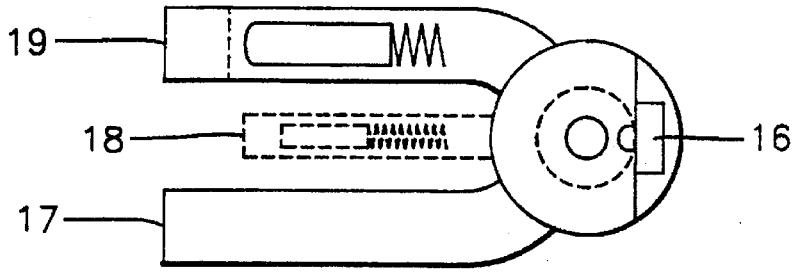
FIG. 9 is a partial sectional view of a container connector according to one form of the present invention.
Figure 10:
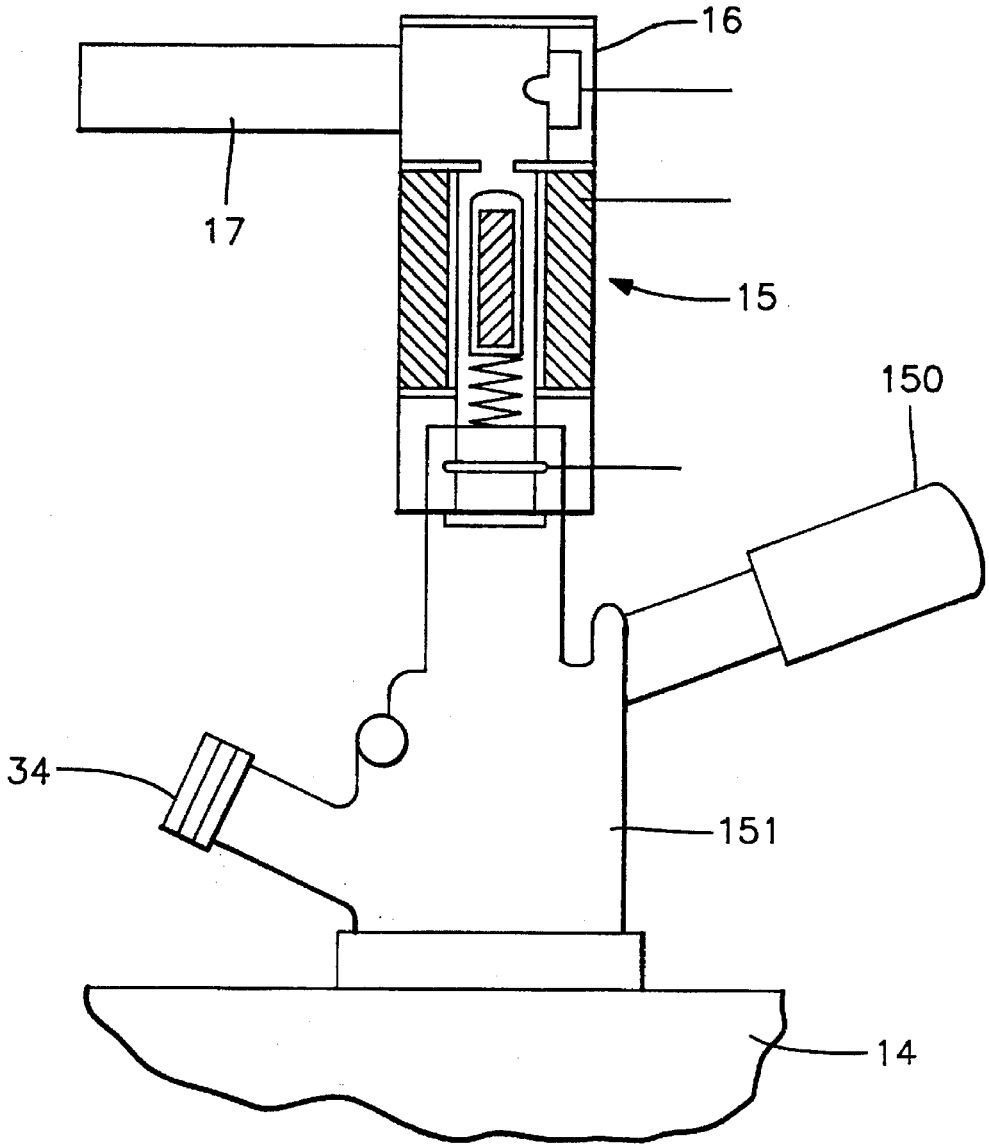
FIG. 10 is a partial sectional view of a container connector according to one form of the present invention.

In particular, the addition of valves enables the re-prime mode, as shown in FIG. 8, to individually re-prime the lines meeting to and from the containers 14 and 14A and therefore if additional full containers are added either at 14 or 14A or at any additional locations which may be easily provided, the individual keg may be automatically re-primed, thus, ensuring a substantially constant supply of liquid to be dispensed.

Figure 6:
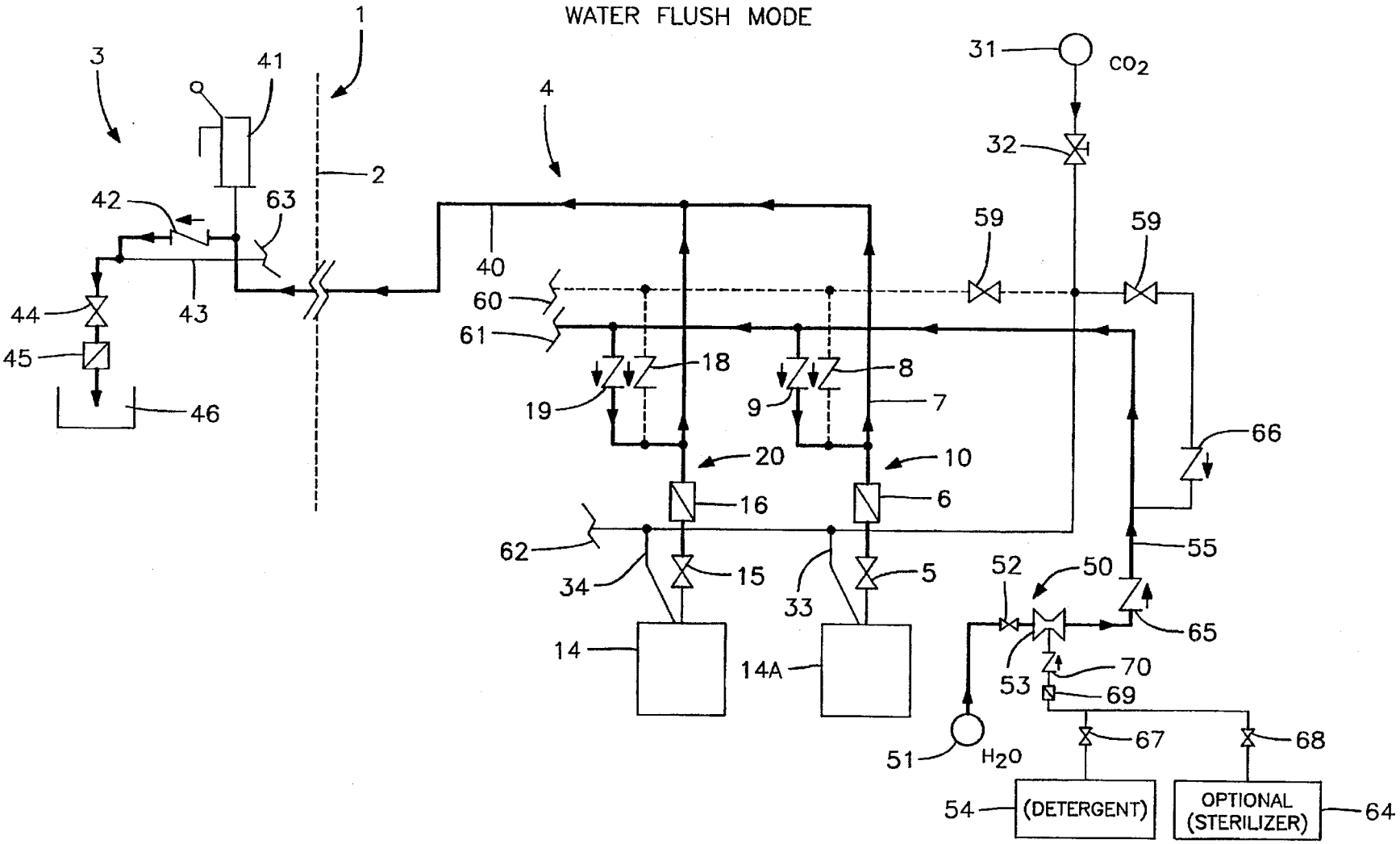
FIG. 6 is a diagrammatic view of one form of the present invention when in flush or pre-rinse mode.

When in the re-prime mode the sensor 45 is used to detect the change from gas which is present due to the re-prime mode being immediately preceded by purge mode, as shown in FIG. 6, to liquid to be dispensed. Thus when sensor 45 detects that a change has occurred from substantially gas to substantially liquid the logic circuit may terminate the re-prime mode thus ensuring that substantially little dispensable liquid is drained or wasted. Re-prime mode occurs with remotely operable valve 44 in its open state.

In the preferred arrangement, connection to valve 42 is located as far 'downstream' as possible, and preferably as close as possible to dispenser tap 41.

Any or all of the modes making up the cleaning cycle, (ie. purge, clean, flush, re-prime), may be programmed to be carried out in the sequence of one or more individual lines from the kegs 14 and 14A to the outlet taps 41, and any, all or additional modes may be programmed to achieved desired cleaning and/or sterilizing performance. The cleaning cycle may include wait states to ensure correct contact time.

As can be seen from the Figures the dispense section 3 of the beverage dispensing system 1, in preferred forms of the invention, contains a dispenser or tap 41. This dispenser may be of any suitable type known in the art to which the invention relates. In preferred forms of the invention this dispenser tap 41 comprises a manually openable, manually closable tap. Other forms of the invention are envisaged in which the dispenser or tap 41 may be controlled to some degree remotely such as by an electrically operable solenoid valve which would allow substantially automatic cleaning of such dispensers.

It is obvious to those skilled in the art to which the invention relates that the preferred form of the invention can be expanded to utilise a greater number of containers, ie. more than two.

This may be achieved by, for example, extending the hoses at 60 (optional), 61 and 62. The various valves and sensors, for example, 10 are provided for each additional container. A variety of dispensers 41 may also be provided which will require extending the hoses at 63.

The ease of cleaning a system such as described in which no manual effort is required such as to disconnect kegs and/or set bar dispensers will help to ensure that cleaning operations are carried out regularly.

The system ensures all fluid pathways except actual keg inlet tap and bar dispensing tap are therefore clean.

It is envisaged that it will be necessary to clean the above said taps on a less frequent basis as follows:

1. Either during the standard clean cycle (or under the control of a special cleaning cycle) the bar dispensing taps are manually (or if solenoid operated, electrically) held open for at least part of the full duration of the clean cycle and drained into containers or into pathways connecting bar dispensing taps to a drain.
2. Keg taps are removed and are collectively or individually washed or back-flushed through with cleaning substance under manual control, or as part of a special cleaning cycle.

Figure 11:
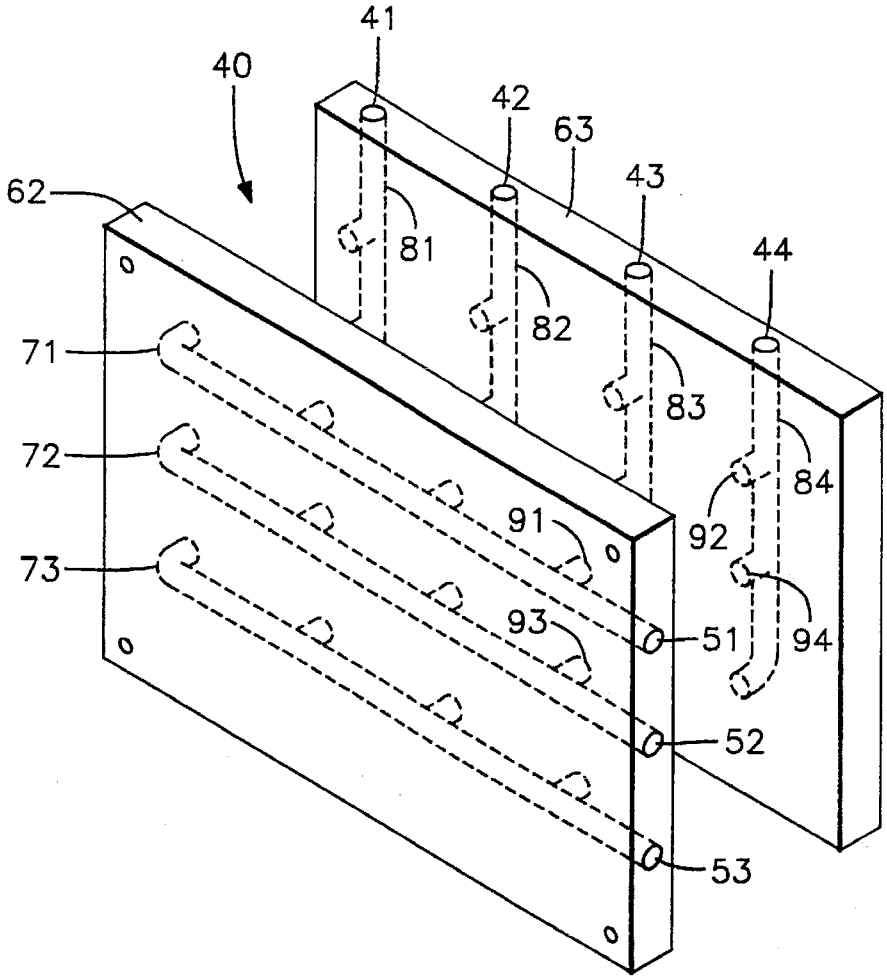
FIG. 11 is a partial exploded isometric view of an array of remotely operable valves according to another form of the present invention.
Figure 12:
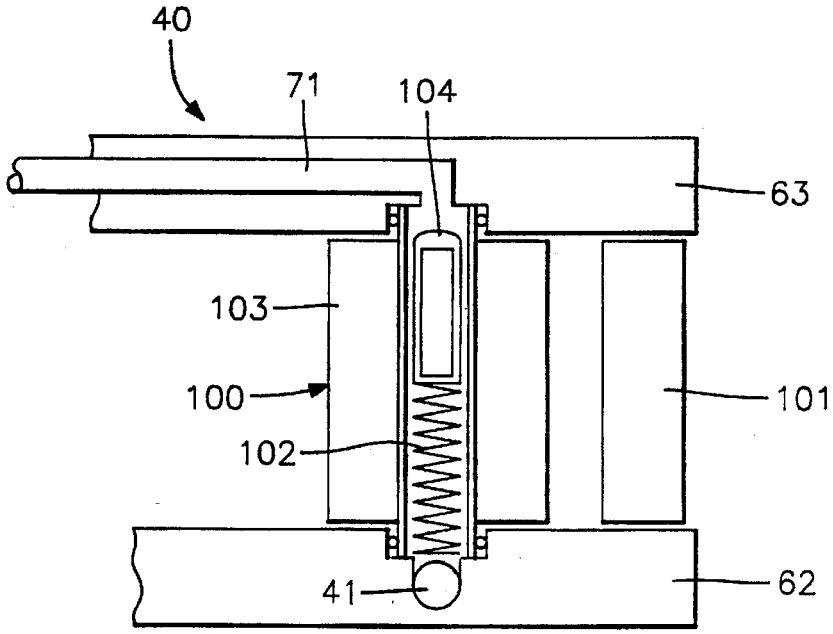
FIG. 12 is a partial sectional view of a remotely operable valve of the form of the invention shown in FIG. 11.

The array of remotely operable valves 40 as shown in FIGS. 11 and 12 provides fluid communication means between fluid pathways 41, 42, 43 and 44 and fluid pathways 51, 52 and 53. In the form of the invention as shown in the Figures, the array is produced from two substantially planar blocks 62 and 63, for example, nylon blocks. Contained within these blocks are a series of substantially parallel channels 71, 72, 73 and in 81, 82, 83 and 84. The fluid channels are interconnected through apertures or similar, for example, 91, 92, 93 and 94. Between the said pairs of aperture, for example, 91 and 92, there is present a remotely operable valve means 100. The valve means, as shown in the example given in FIG. 12, provides fluid communication between the fluid pathways, for example, 71 and 41. In forms of the invention the valve is of a normally closed type and biased with a spring 102, and may consist of a in-line, direct acting solenoid valve with or without integral microprocessor circuits allowing said solenoid valves to be part of a distributed control network. However, other forms of remotely operable valve means are envisaged. The blocks of material 62 and 63 are preferably joined by a spacer element 101.

Figure 20:
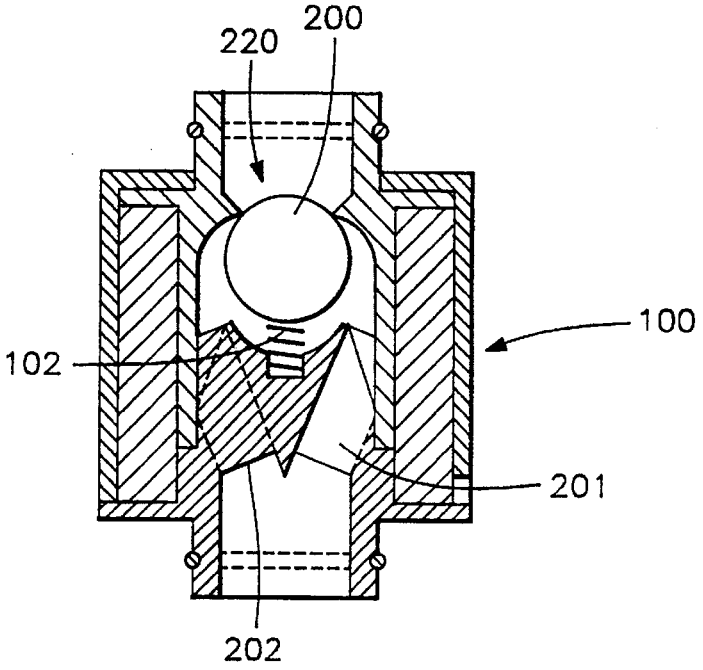
FIG. 20 is a partial sectional view of an alternative remotely operable valve with the form of the invention as shown in FIG. 11.

In an alternative preferred form of the invention as illustrated in FIG. 20 the valve 100 is in the form of a ball valve. The ball 220 in its normal position ocludes an opening 200. In the preferred form of the invention the ball is biased in to place by a biasing means 102. In the preferred form of the valve there are two fluid pathways 201 and 202 providing for flow of the fluid when the valve is in its open condition.

It can be seen that the array of remotely operable valves may provide selective fluid communication, for example, between containers from which liquid is to be dispensed under gas pressure connected to the fluid inlets 41, 42, 43 and 44 and a variety of fluid dispensing, for example, taps connected to the fluid outlets 51, 52 and 53. Therefore, upon the selective opening of the various remotely operable valves 100 the container connected to a particular tap or dispenser can be selected and/or a particular dispenser dispensing from a particular container can be selected. This may be under the control of a logic circuit and may be included in a liquid dispensing under pressure system as hereinbefore described.

Should any of the matrix of interconnections be undesirable, for example, in a beer dispensing system the dispensing of a stout from a bitter beer tap the interconnection between the fluid pathway connecting that container to a dispenser may be simply blocked by a plug or similar.

Figure 19:
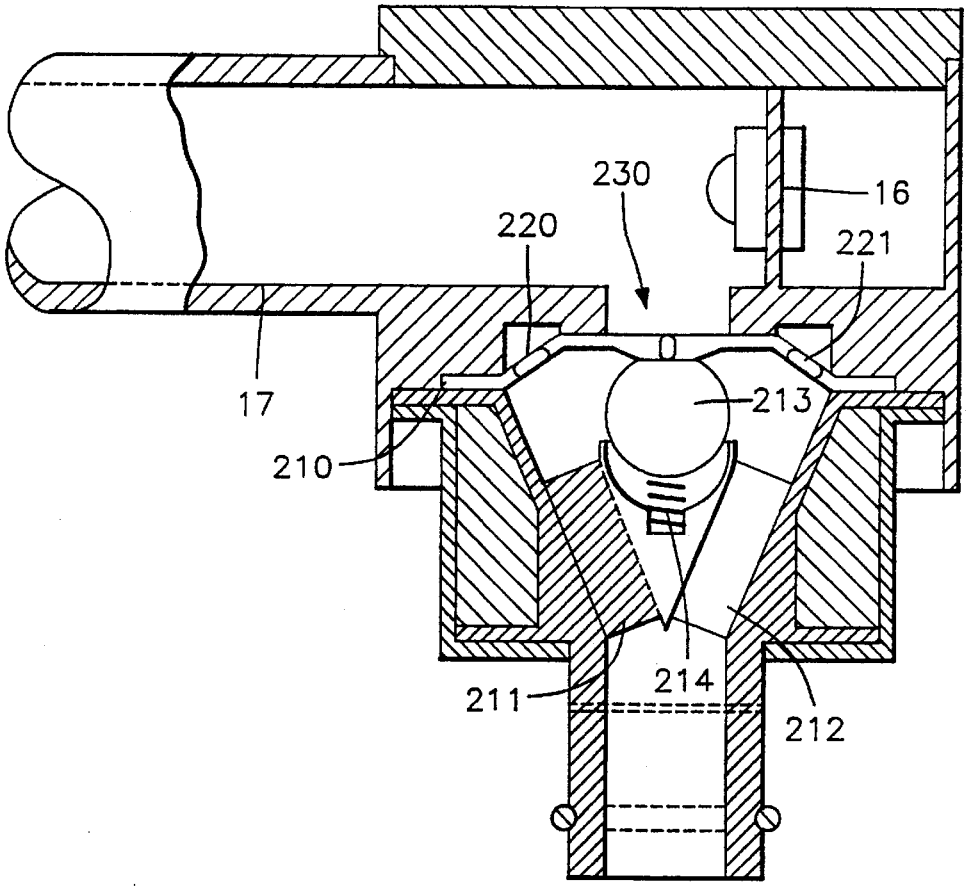
FIG. 19 is a partial sectional view of an alternative remotely operable valve associated with a container connector according to one form of the present invention.

FIG. 19 illustrates an alternative remotely operable valve associated with a container connector. According to another form of the present invention this form of the valve is of the type having a ball 213 biased by biasing means 214. The ball has associated therewith a diaphram 210. The diaphram has apertures therethrough 220 and 221. When in the closed position the portion of the diaphram 210 not having apertures therethrough ocludes an opening 230 thus preventing fluid flow. When the valve moves towards the open condition, fluid is able to flow through the apertures 220 and 221 and through the fluid passageways 211 and 212.

It will be obvious to those skilled in the art to which the invention relates that additional containers (whether a single container or containers connected in series or parallel may be easily added by, for example, extending the fluid pathways at 61 and 62. The use of the hereinbefore described array of remotely operable valves in conjunction with these additional containers and/or additional dispensing means will produce a system which has flexibility as to which container is dispensed from which tap and also enables the supply of liquid to be substantially uninterrupted as containers run out and new full ones are automatically, under the influence of the logic circuit, connected into the system.

In the preferred arrangement, FIG. 1, the relative positions of sensors 6, 16, 45 may optionally be interchanged with their associated remotely operable valves 5, 15, 44.

It will be obvious to those skilled in the art to which the invention relates that the provision of means to switch between containers as the containers become empty and/or to substantially automatically clean and/or sterilise a liquid delivery system, can be applied to a wide range of beverage dispensing systems, whether gas pressure driven or pumped. Included in such applications are flavoured carbonated beverage dispensing systems, typically referred to as "post mix" systems, which often utilise containers of the "Bag-in-Box" form.

I claim:

1. In a gasified liquid dispensing system having a valved outlet, for dispensing via said valved outlet liquid from one of a plurality of kegs connected into the system, the system being of a kind where for each keg there is a dedicated keg connection means for selectively establishing a pressurized liquid flow path to said valved outlet via said keg connection means of the liquid content of said keg, the arrangement whereby (i) each said keg connection means defines
- a gas inlet for a pressurized gas from a source of pressurized gas connected thereto,
- a gas passageway for pressurized gas from said gas inlet,
- a gas outlet for pressurized gas from said gas passageway,
- a liquid inlet for liquid being displaced from the keg,
- a liquid passageway for liquid received via said liquid inlet,
- a liquid outlet from said liquid passageway adapted to engage means providing said pressurized liquid flow path to said valved outlet,
- said gas outlet and said liquid inlet being communicable with the interior of one of said kegs when said keg connection means is engaged to said one of said kegs by its said keg engaging means, so that when in use gas issuing into said one of said kegs from said gas outlet of its keg connection means can displace liquid from said keg through said keg connection means into said liquid flow path via said liquid inlet, said liquid passageway and said liquid outlet, (ii) the liquid flow path of each keg is distinct from keg connection means of any other keg in the system, (iii) a signal actuable valve is located in one of:
- said liquid inlet,
- said liquid passageway,
- said liquid outlet, and
- said liquid flow path adjacent the keg connection means,
- for opening and closing said one of said liquid inlet, said liquid passageway, said liquid outlet and said liquid flow path, (iv) a liquid flow sensor capable of generating a signal indicative of the flow of fluid past said sensor changing from liquid to gas, is arranged in one of:
- said liquid inlet,
- said liquid passageway,
- said liquid outlet, and
- said liquid flow path adjacent said keg connection means, (v) dedicated logic means at each said keg connection means to provide output signals to said signal actuable valve of its keg connection means directing said signal actuable valve to open on receipt by such a dedicated logic means of an "open command" signal and to close on receipt by such a dedicated logic means of a "close command" signal and on receipt by such a dedicated logic means of a liquid flow to gas flow indicative signal from its liquid flow sensor, (vi) each of said dedicated logic means provides at least one output signal to a system control computer remote from each said dedicated logic means;

(vii) each liquid flow sensor for detecting a change of liquid flow to gas flow from its keg being adapted to instruct its dedicated logic means to close its signal actuable valve unless overridden by a control signal from said system control computer, and (viii) the system control computer is adapted to recognize from said at least one output signal from each dedicated logic means which keg connection means connected to a keg has its signal actuable valve open and which keg connection means connected to a keg has its signal actuable valve closed and is further adapted to generate in a dispense mode at least an open command signal to the dedicated logic means of a keg connection means connected to a liquid containing keg, such an open command signal being provided so as to cause the dedicated logic means to signal its signal actuable valve to open thereby to rapidly substitute its chosen liquid into a pressurized liquid flow path to a valved outlet for the previously flowing liquid from a keg just closed from such a pressurized liquid flow path by its own dedicated logic means and associated signal actuable valve.

2. A system arrangement of claim 1 wherein a choice of a keg to have its liquid issue into a said liquid flow path from a selection of kegs with liquid content appropriate for said liquid flow path is determined by said system control computer referencing to the earliest manufacture date of the selection of kegs, such a date having been entered into the computer.

3. A system arrangement as claimed in claim 2 wherein the manufacture date is entered manually adjacent each said keg connection means.

4. A system arrangement as claimed in claim 1 wherein said system control computer can dispatch a said "close command" to any one of said dedicated logic means.

5. A system arrangement as claimed in claim 1 wherein said system control computer can dispatch a said "open command" to any one of said dedicated logic means.

6. A system arrangement as claimed in claim 1 wherein when in a system "clean cycle" mode, said system control computer can dispatch an "open command" to any one of said dedicated logic means irrespective of whether associated with a liquid containing keg.

7. A system arrangement as claimed in claim 1 wherein each said signal actuable valve is biased to a closed condition and can be actuated against said bias to a said open condition.

8. A system arrangement as claimed in claim 1 wherein said system has a conduit and a keg connected each to one of a plurality of said keg connection means, said conduit being arranged such that:

when said conduit is in a substantially fluid tight engagement with said gas outlet, said conduit opens at a lower level within said keg than does the liquid inlet, and when said conduit is in a substantially fluid tight engagement with said liquid inlet, said conduit opens at a lower level within said keg than does the gas outlet.

9. A system arrangement as claimed in claim 1 wherein a valve is included in one of:

said gas inlet, said gas passageway, said gas outlet, and a conduit from the gas outlet.

10. A system arrangement as claimed in claim 1 wherein each said keg connection means together with its dedicated logic means includes four electrically conductive connections.

11. A system arrangement as claimed in claim 10 wherein said four electrical connections are as follows:

an electrical power connection;

an earth connection;

a data communications connection; and a data input/output ground connection.

12. A system as claimed in claim 1 wherein kegs in the system are linked in parallel.

13. A keg connection means component assembly suitable for use in a gasified liquid dispensing system having a valved outlet, for dispensing via said valved outlet liquid from one of a plurality of kegs connected into the system, the system being of a kind where for each keg there is a dedicated keg connection means for selectively establishing a pressurized liquid flow path to said valved outlet via said keg connection means of the liquid content of said keg, the arrangement whereby (i) each said keg connection means defines a gas inlet for a pressurized gas from a source of pressurized gas connected thereto, a gas passageway for pressurized gas from said gas inlet, a gas outlet for pressurized gas from said gas passageway, a liquid inlet for liquid being displaced from the keg, a liquid passageway for liquid received via said liquid inlet, a liquid outlet from said liquid passageway adapted to engage means providing said pressurized liquid flow path to said valved outlet, said gas outlet and said liquid inlet being communicable with the interior of one of said kegs when said keg connection means is engaged to said one of said kegs by its said keg engaging means so that when in use gas issuing into said one of said kegs from said gas outlet of its keg connection means can displace liquid from said keg through said keg connection means into said liquid flow path via said liquid inlet, said liquid passageway and said liquid outlet, (ii) the liquid flow path of each keg is distinct from keg connection means of any other keg in the system, (iii) a signal actuable valve is located in one of:

said liquid inlet, said liquid passageway, said liquid outlet, and said liquid flow path adjacent the keg connection means, for opening and closing said one of said liquid inlet, said liquid passageway, said liquid outlet and said liquid flow path, (iv) a liquid flow sensor capable of generating a signal indicative of the flow of fluid past said sensor changing from liquid to gas, is arranged in one of:

said liquid inlet, said liquid passageway, said liquid outlet, and said liquid flow path adjacent said keg connection means, (v) dedicated logic means at each said keg connection means to provide output signals to said signal actuable valve of its keg connection means directing said signal actuable valve to open on receipt by such a dedicated logic means of an "open command" signal and to close on receipt by such a dedicated logic means of a "close command" signal and on receipt by such a dedicated logic means of a liquid flow to gas flow indicative signal from its liquid flow sensor;

(vi) each said dedicated logic means provides at least one output signal to a system control computer remote from each said dedicated logic means, (vii) each liquid flow sensor for detecting a change of liquid flow to gas flow from its keg being adapted to instruct its dedicated logic means to close its signal actuable valve unless overridden by a control signal from said system control computer; and (viii) the system control computer is adapted to recognize from said at least one output signal from each dedicated logic means which keg connection means connected to a keg has its signal actuable valve open and which keg connection means connected to a keg has its signal actuable valve closed and is further adapted to generate in a dispense mode at least an open command signal to the dedicated logic means of a keg connection means connected to a liquid containing keg, such an open command signal being provided so as to cause the dedicated logic means to signal its signal actuable valve to open thereby to rapidly substitute its chosen liquid into a pressurized liquid flow path to a valved outlet for the previously flowing liquid from a keg just closed from such a pressurized liquid flow path by its own dedicated logic means and associated signal actuable valve, said component assembly comprising means defining said gas inlet for pressurized gas from said source of pressurized gas connected thereto, said gas passageway for pressurized gas from said gas inlet, said gas outlet for pressurized gas from said gas passageway, said liquid inlet for liquid to be displaced from a keg, said liquid passageway for liquid received via said liquid inlet, said liquid outlet from said liquid passageway adapted to engage means providing a pressurized liquid flow path to a valved outlet from which liquid might be dispensed, means to engage said component assembly to a keg such that said gas outlet and said liquid inlet are each communicable with the interior of any one of said plurality of kegs, said signal actuable valve, and said liquid flow sensor.

14. A component assembly as claimed in claim 13 wherein there are four electrically conductive connections into said component assembly only, two for the purpose of providing electrical power and two for data communication purposes.

15. A component assembly as claimed in claim 14 wherein said two electrically conductive connections for the purpose of providing electrical power provide electrical power to said dedicated logic means.

16. A component assembly as claimed in claim 14 wherein said two electrically conductive connections into said component assembly for data communications purposes are connected into said dedicated logic means.

17. A component assembly as claimed in claim 14 wherein electrical power is supplied to said liquid flow sensor from at least one of said dedicated logic means and said two electrically conductive connections for the purposes of providing electrical power.

18. A component assembly as claimed in claim 14 wherein said liquid flow sensor is connected to at least one of said dedicated logic means and said two electrically conductive connections for data communication purposes.

19. A component assembly as claimed in claim 13 wherein a choice of a keg to have its liquid issue into a said liquid flow path from a selection of kegs with liquid content appropriate for said liquid flow path is determined by said system control computer referencing to the earliest "inputted manufacture date" of the selection of kegs, such a date having been entered into the computer.

20. A component assembly as claimed in claim 13 wherein the manufacture date is entered adjacent each said keg connection means.

21. A component assembly as claimed in claim 13 wherein said system control computer can dispatch a said "close command" to any one of said dedicated logic means.

22. A component assembly as claimed in claim 13 wherein said system control computer can dispatch a said "open command" to any one of said dedicated logic means.

23. A component assembly as claimed in claim 13 wherein when in a system "clean cycle" mode, said system control computer can dispatch an "open command" to any one of said dedicated logic means irrespective of whether associated with a liquid containing keg.

24. A component assembly as claimed in claim 13 wherein each said signal actuable valve is biased to a closed condition and can be actuated against said bias to a said open condition.

25. A component assembly as claimed in claim 13 wherein said system has a conduit and a keg connected each to one of a plurality of said keg connection means, said conduit being arranged such that:

when said conduit is in a substantially fluid tight engagement with said gas outlet, said conduit opens at a lower level within said keg than does the liquid inlet, and when said conduit is in a substantially fluid tight engagement with said liquid inlet, said conduit opens at a lower level within said keg than does the gas outlet.

26. A component assembly as claimed in claim 13 wherein a valve is included in one of:

said gas inlet, said gas passageway, said gas outlet, and a conduit from the gas outlet.

* * * * *